US009042785B2

(12) United States Patent
Doshida

(10) Patent No.: US 9,042,785 B2
(45) Date of Patent: May 26, 2015

(54) IMAGE FORMING APPARATUS HAVING PHOTOSENSITIVE MEMBER AND INTERMEDIATE TRANSFER MEMBER SUBJECTED TO DRIVING ROTATION CONTROL INDEPENDENTLY

(71) Applicant: CANON KABUSHIKI KAISHA, Tokyo (JP)

(72) Inventor: Takaaki Doshida, Moriya (JP)

(73) Assignee: CANON KABUSHIKI KAISHA (JP)

( * ) Notice: Subject to any disclaimer, the term of this patent is extended or adjusted under 35 U.S.C. 154(b) by 0 days.

(21) Appl. No.: 14/210,784

(22) Filed: Mar. 14, 2014

(65) Prior Publication Data

US 2014/0270852 A1 Sep. 18, 2014

(30) Foreign Application Priority Data

Mar. 14, 2013 (JP) ..... 2013-051880

(51) Int. Cl.
*G03G 15/00* (2006.01)
*G03G 15/16* (2006.01)

(52) U.S. Cl.
CPC ..... *G03G 15/1615* (2013.01)

(58) Field of Classification Search
CPC ..... G03G 15/0131; G03G 15/01615; G03G 15/0757; G03G 2215/0129; G03G 15/50; G03G 15/0505
See application file for complete search history.

(56) References Cited

U.S. PATENT DOCUMENTS

| | | | | |
|---|---|---|---|---|
| 6,556,798 | B2 * | 4/2003 | Rimai et al. | 399/167 |
| 2009/0214241 | A1 * | 8/2009 | Kawaguchi et al. | 399/66 |
| 2010/0082163 | A1 * | 4/2010 | Masuda et al. | 700/279 |
| 2010/0226676 | A1 * | 9/2010 | Funamoto et al. | 399/66 |
| 2011/0268475 | A1 * | 11/2011 | Birumachi | 399/167 |
| 2012/0003010 | A1 * | 1/2012 | Birumachi | 399/167 |
| 2012/0163846 | A1 * | 6/2012 | Andoh et al. | 399/66 |
| 2013/0058683 | A1 * | 3/2013 | Doshida | 399/167 |
| 2013/0287442 | A1 * | 10/2013 | Birumachi | 399/167 |
| 2014/0169812 | A1 * | 6/2014 | Takatsu | 399/38 |
| 2014/0169831 | A1 * | 6/2014 | Doshida et al. | 399/167 |
| 2014/0178101 | A1 * | 6/2014 | Takatsu | 399/167 |

FOREIGN PATENT DOCUMENTS

JP 2012-032515 A 2/2012

* cited by examiner

*Primary Examiner* — Clayton E Laballe
*Assistant Examiner* — Ruifeng Pu
(74) *Attorney, Agent, or Firm* — Rossi, Kimms & McDowell LLP

(57) ABSTRACT

An image forming apparatus stabilized in transferability of an image from the photosensitive member to the intermediate transfer belt. The image forming apparatus includes photosensitive drums and an intermediate transfer belt (ITB) that rotates in contact with each drum, brushless DC motors for driving the drum and the ITB for rotation. Rotary encoders associated with the drum and the ITB detect respective rotational speeds thereof. A controller sets a target value for the drum-associated rotary encoder for making the surface speeds of the drum and the belt equal to each other during normal printing operation, from a detection value from the drum-associated rotary encoder in a state of the drum being friction-driven by the belt at the primary transfer section, and controls the drum-associated motor such that the target value becomes a detection value.

14 Claims, 15 Drawing Sheets

IMAGE FORMING APPARATUS HAVING PHOTOSENSITIVE MEMBER AND INTERMEDIATE TRANSFER MEMBER SUBJECTED TO DRIVING ROTATION CONTROL INDEPENDENTLY

BACKGROUND OF THE INVENTION

1. Field of the Invention

The present invention relates to an image forming apparatus that includes a photosensitive member and an intermediate transfer member subjected to driving rotation control independently of each other, for rotation in contact with each, and performs control such that a difference in speed between the respective members at a contact portion is reduced to zero.

2. Description of the Related Art

Conventionally, an electrophotographic image forming apparatus, which is used as a copy machine or a multifunction peripheral, performs printing operations by forming an image for which a print command is received on a photosensitive drum as a toner image, transferring the toner image onto a recording sheet, and then fixing the toner image on the recording sheet. The electrophotographic image forming apparatus is provided with an intermediate transfer belt for having the toner image transferred thereto from the photosensitive drum and transferring the toner image onto a recording sheet.

Here, it is demanded that the photosensitive drum and the intermediate transfer belt are driven such that the speed of a surface on which the toner image is formed (hereafter referred to as "the surface speed") is constant. In a case where the process speed of the photosensitive drum and that of the intermediate transfer belt are not constant, this causes image defects on an image transferred onto a recording sheet, which are called color shift (positional displacement between respective colors) and periodic positional displacement called banding. To overcome the above-mentioned problem, a motor as a drive source is subjected to speed feedback control using various speed detection sensors whereby the rotational speeds of the photosensitive drum and the intermediate transfer belt are controlled to respective target speeds. Note that as a drive motor, one employing a brushless DC motor is often used because of low-cost, quietness, and high efficiency. Further, for the speed feedback control using the brushless DC motor, a motor control method has been put into practical use which uses a rotary encoder disposed on a rotating shaft of the photosensitive drum and thereby controls the motor such that the rotating speed thereof becomes constant.

However, in the above-mentioned speed feedback control, only the rotational speed of the drum shaft is detected, but it does not directly detect the surface speed of the photosensitive drum. Therefore, it is difficult to control the surface speed of the photosensitive drum to a target speed e.g. due to an accuracy allowance of the diameter of the photosensitive drum and the like. The same problem occurs to the intermediate transfer belt due to an accuracy error of the diameter of a roller, variation in thickness of the intermediate transfer belt, and the like.

Further, aging and a change in the mechanical structure dependent on an operation environment are expected, and in view of transferability at a primary transfer section and interference of a drive system, a speed difference is sometimes provided between the surface speed of the photosensitive drum and that of the intermediate transfer belt. However, the speed difference is set to a value sufficiently small (e.g. 0.2%) with respect to the target process speed, and hence the set speed difference cannot be achieved due to the above-mentioned allowance in design of the mechanical structure and changes with time in the process speed. One method of avoiding this problem is to provide surface speed sensors for detecting surface speeds of the photosensitive drum and the intermediate transfer belt. However, from the viewpoint of cost and detection accuracy, it is difficult to actually implement the method.

To overcome this inconvenience, there has been proposed a method of deriving a rotational speed setting value of the rotary encoder when the speed difference between the surface speed of the photosensitive drum and that of the intermediate transfer belt becomes zero, without using any surface speed sensor (e.g. Japanese Patent Laid-Open Publication No. 2012-032515).

Technical points in such related art are shown in FIGS. 15A to 15C.

FIGS. 15A to 15C are diagrams useful in explaining related art for deriving a rotational speed setting value of the rotary encoder when the speed difference becomes zero, without using any surface speed sensor. FIG. 15A is a diagram showing changes with time of the target rotational speed value ($V_D$) of the photosensitive drum, in a case where the intermediate transfer belt is drivingly controlled to a predetermined rotational speed ($V_{ITB_TAR}$), and the photosensitive drum is drivingly controlled while having the speed thereof varied within a speed range between a low speed value and a high speed value, including the predetermined rotational speed $V_{ITB_TAR}$. Note that the speed control of the photosensitive drum and the intermediate transfer belt is executed based on respective outputs from rotational speed sensors provided on rotating shafts thereof. Further, FIG. 15B is a diagram showing torque values $T_D$ produced by the photosensitive drum when the target rotational speed value is varied. FIG. 15C is a diagram showing degrees of change in the torque occurring when the target rotational speed value is varied.

FIG. 15C shows that when the surface speed of the photosensitive drum at the primary transfer section exceeds the surface speed of the intermediate transfer belt, the lord torque of the photosensitive drum suddenly changes. In other words, when the photosensitive drum is drivingly controlled to a target rotational speed value before or after which the degree of change in the torque value $T_D$ is large, the speed difference becomes equal to zero, and hence it is possible to set the target value of the surface speed in the image formation process to the target rotational speed value. Further, since the rotational speed setting values of the photosensitive drum and the intermediate transfer belt at which the speed difference becomes zero are derived, it is possible from this to set a desired speed difference.

As described above, in the method disclosed in Japanese Patent Laid-Open Publication No. 2012-032515, a rotational speed setting value before and after which the degree of change in torque occurring to the photosensitive drum becomes maximum is set as the target rotational speed value at which the speed difference becomes zero. According to this method, however, when the intermediate transfer belt is made of a resilient material or a like other adherent material, the friction coefficient varies with the speed difference, and particularly in a region where the speed difference is zero or in its vicinity, there occurs a phenomenon that the intermediate transfer belt repeatedly slips and tacks. Normally, in a case where the photosensitive drum is slower than the intermediate transfer belt, the intermediate transfer belt pulls the photosensitive drum by friction torque at the primary transfer section, whereas in a case where the photosensitive drum is faster than the intermediate transfer belt, the photosensitive drum pulls the intermediate transfer belt at the primary transfer section. Therefore, in the state of the speed difference being zero, it is expected that the torque caused by the photosensitive drum shows a largest degree of change. However, if the above-mentioned phenomenon occurs, the torque caused by the photosensitive drum drastically changes also at a point where the friction coefficient at the primary transfer section changes, and hence the rotational speed setting value before and after which the degree of change in the torque is maximum does not necessarily indicate the state of the circumferential speed being zero. Therefore, this method has a problem that the accuracy of deriving the point at which the speed difference becomes zero is not high.

SUMMARY OF THE INVENTION

The present invention provides an image forming apparatus that is capable of correcting transfer defects caused by a speed difference between respective portions in contact of a photosensitive member and an intermediate transfer belt which are subjected to driving rotation control independently of each other, for rotation in contact with each, to thereby stabilize transferability of an image from the photosensitive member to the intermediate transfer belt.

In a first aspect of the present invention, there is provided an image forming apparatus comprising a photosensitive member configured to have a toner image formed thereon, an intermediate transfer member configured to be rotatable in contact with the photosensitive member, for having the toner image on the photosensitive member transferred thereon, a first drive unit configured to drive the photosensitive member for rotation, a second drive unit configured to drive the intermediate transfer member for rotation, a first speed detection unit configured to detect a rotational speed of the photosensitive member, a second peed detection unit configured to detect a rotational speed of the intermediate transfer member, and a control unit configured to control the first drive unit and the second drive unit, wherein the control unit performs control other than control for normal printing operation, such that the first drive unit drives the photosensitive member with a predetermined rotational torque, in a state causing the intermediate transfer member to rotate at a predetermined rotational speed, and sets, based on a detection value from the first speed detection unit in a state in which the photosensitive member is friction-driven by the intermediate transfer member at a contact surface of the photosensitive member and the intermediate transfer member, which detection value is obtained by the control other than the control for the normal printing operation, a target value of the first speed detection unit for making a surface speed of the photosensitive member and a surface speed of the intermediate transfer member during the normal printing operation equal to each other, and controls the first drive unit such that the target value becomes a detection value.

In a second aspect of the present invention, there is provided an image forming apparatus comprising an image forming apparatus comprising an photosensitive member configured to have a tone image formed thereon, an intermediate transfer member configured to be rotatable in contact with the photosensitive member, for having the toner image on the photosensitive member transferred thereon, a first drive unit configured to drive the photosensitive member for rotation, a second drive unit configured to drive the intermediate transfer member for rotation, a first speed detection unit configured to detect a rotational speed of the photosensitive member, a second peed detection unit configured to detect a rotational speed of the intermediate transfer member, and a control unit configured to control the first drive unit and the second drive unit, wherein the control unit performs control other than control for normal printing operation, such that the second drive unit drives the intermediate transfer member with a predetermined rotational torque, in a state causing the photosensitive member to rotate at a predetermined rotational speed, and sets, based on a detection value from the second speed detection unit in a state in which the intermediate transfer member is friction-driven by the photosensitive member at a contact surface of the photosensitive member and the intermediate transfer member, which detection value is obtained by the control other than the control for the normal printing operation, a target value of the second speed detection unit for making a surface speed of the photosensitive member and a surface speed of the intermediate transfer member during the normal printing operation equal to each other, and controls the second drive unit such that the target value becomes a detection value.

According to the present invention, from a detection value from a speed detection unit in a state in which one of the photosensitive member and the intermediate transfer member is friction-driven by the other, at the contact surface of the two members, the control unit sets a target value of the speed detection unit, for making a surface speed of the photosensitive member and a surface speed of the intermediate transfer member equal to each other during normal printing operation. Then, the control unit controls the first drive unit or the second drive unit such that the detection value becomes the target value. This makes it possible to calculate a rotational speed setting value at which the speed difference between the photosensitive member and the intermediate transfer belt becomes zero, without being affected by lowering of measurement accuracy due to changes in the fiction coefficient at the primary transfer section. Therefore, it is possible to stabilize transferability at the primary transfer section. Further, by setting an appropriate speed difference with respect to the determined rotational speed setting value, it is possible to further stabilize the transferability.

Further features of the present invention will become apparent from the following description of exemplary embodiments (with reference to the attached drawings).

DESCRIPTION OF THE EMBODIMENTS

The present invention will now be described in detail below with reference to the accompanying drawings showing embodiments thereof.

Figure 1:
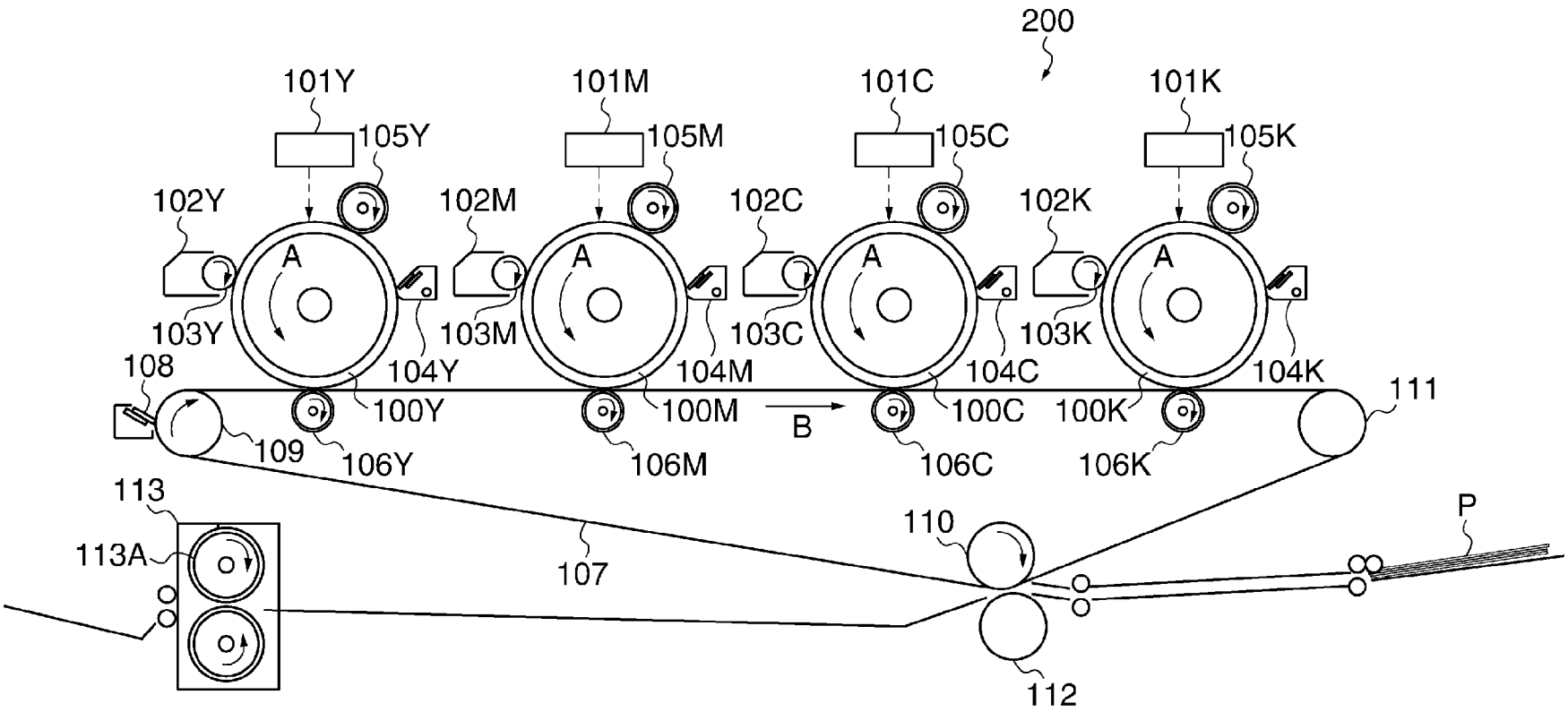
FIG. 1 is a schematic cross-sectional view of essential parts of an image forming apparatus according to a first embodiment of the present invention.

FIG. 1 is a schematic cross-sectional view of essential parts of an image forming apparatus according to a first embodiment. The image forming apparatus, denoted by reference numeral 200, is an electrophotographic color digital copy machine. The image forming apparatus 200 is not necessarily required to be a copy machine but may also be a multifunction peripheral or a facsimile machine, and further may be not only a color machine but also a monochrome digital copy machine, multifunction peripheral or facsimile machine. In short, any suitable image forming apparatus may be employed insofar as it is configured to transfer a toner image formed on a photosensitive member onto an intermediate transfer member.

Referring to FIG. 1, a plurality of, e.g. four image forming units respectively including photosensitive drums 100Y, 100M, 100C, and 100K, which are associated with colors of yellow (Y), magenta (M), cyan (C), and black (K), respectively, are arranged substantially in the horizontal direction. Component elements are the same between the image forming units, and hence hereinafter, when the component elements are not differentiated from each other in association with respective different image forming units, the same reference numerals are used, whereas when the component elements are differentiated, Y, M, C, or K is attached to each of the reference numerals. The photosensitive drums 100Y to 100K as the photosensitive members are rotatable, and rotate in a direction indicated by respective arrows A in FIG. 1.

The image forming units include not only the photosensitive drums 100Y to 100K, but also primary electrostatic charging devices (electrostatic charging rollers) 105Y, 105M, 105C, and 105K, exposure devices 101Y, 101M, 101C, and 101K, and developing devices 102Y, 102M, 102C, and 102K, respectively. The developing devices 102Y to 102K include developing sleeves 103Y, 103M, 103C, and 103K, respectively. The image forming units further include cleaner blades 104Y, 104M, 104C, and 104K, associated with the photosensitive drums 100Y to 100K, respectively.

The primary electrostatic charging devices 105Y to 105K uniformly electrostatically charge the surfaces of the photosensitive drums 100Y to 100K, respectively. Further, the exposure devices 101Y to 101K expose the electrostatically charged surfaces of the photosensitive drums 100Y to 100K based on image information to thereby form electrostatic latent images thereon, respectively.

The developing devices 102Y to 102K develop the electrostatic latent images formed on the surfaces of the respective photosensitive drums 100Y to 100K using the developing sleeves 103Y to 103K, each containing toner of an associated one of chromatic colors, to thereby form toner images, respectively.

Primary transfer rollers 106Y, 106M, 106C, and 106K are disposed at respective locations opposed to the photosensitive drums 100Y to 100K. An endless intermediate transfer belt (denoted as "ITB" in the drawings) 107 as the intermediate transfer member is stretched such that it is conveyed through between the photosensitive drums 100Y to 100K and the primary transfer rollers 106Y to 106K.

The intermediate transfer belt 107 is stretched around a plurality of stretching rollers 109 to 111 and are in contact with the surfaces of the photosensitive drums 100Y to 100K. The intermediate transfer belt 107 rotates in a direction indicated by an arrow B in FIG. 1. The toner images of the respective colors formed on the photosensitive drums 100Y to 100K are sequentially transferred onto the intermediate transfer belt 107 in superimposed relation to thereby form a color image.

The stretching roller 109 is a drive roller that drives the intermediate transfer belt 107, and also functions as a tension roller for controlling tension of the intermediate transfer belt 107 such that the tension is constant. The stretching roller 110 is a secondary transfer internal roller that forms a nip with a secondary transfer external roller 112 disposed at a location opposed to the stretching roller 110.

The toner image on the intermediate transfer belt 107 is transferred onto a recording sheet P at a contact area where the stretching roller 110 and the secondary transfer external roller 112 are brought into contact with each other, and the recording sheet P having the toner image transferred thereon is conveyed into a fixing device 113 disposed at a location downstream of the above-mentioned contact area. The toner image is fixed on the recording sheet P by the fixing device 113, and the recording sheet P is discharged out of the image forming apparatus 200. On the other hand, after the secondary transfer has been performed, remaining toner, paper dust, and the like are cleaned from the intermediate transfer belt 107 by a cleaner 108, whereby the intermediate transfer belt 107 is repeatedly used in the image formation process.

Next, a description will be given of a method of controlling the driving of the photosensitive drum 100 and the intermediate transfer belt 107 as an image forming section of the present embodiment.

Figure 2:
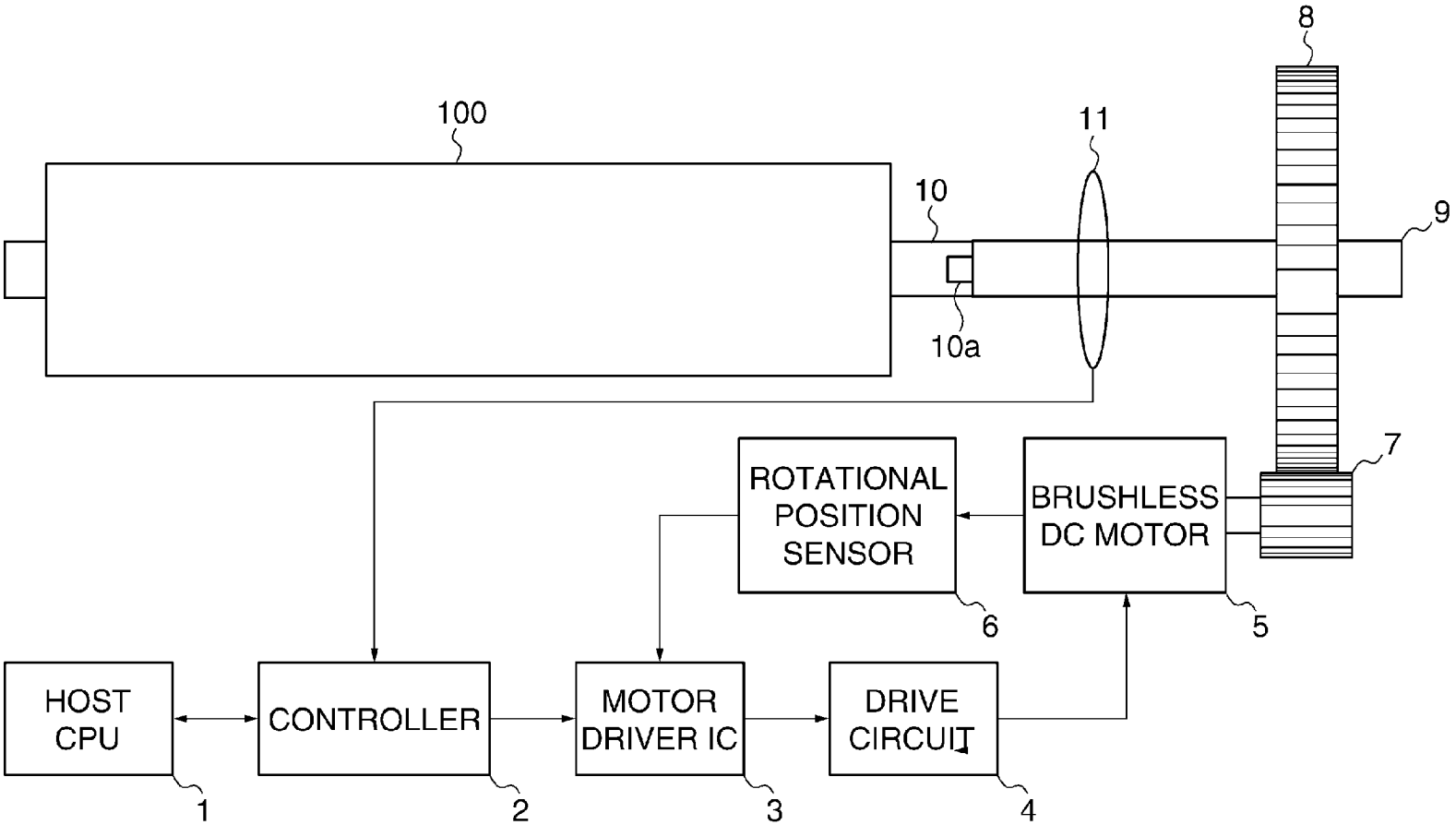
FIG. 2 is a schematic diagram showing the electrical and mechanical arrangement for driving a photosensitive drum appearing in FIG. 1.

FIG. 2 is a schematic diagram showing the electrical and mechanical arrangement for driving the photosensitive drum 100 appearing in FIG. 1. Note that the drums of respective colors of Y, M, C, and K all have the same arrangement, and hence in the following description, Y to K are omitted.

A drum shaft 10 of the photosensitive drum 100 is mechanically connected to a reduction gear shaft 9 via a coupling 10*a*. The reduction gear shaft 9 is engaged with a motor shaft gear 7 via a reduction gear 8. The reduction gear shaft 9 and the reduction gear 8 are fixedly connected to each other by a joint, not shown. The reduction gear shaft 9 is provided with a rotary encoder 11 as a first speed detection unit, for detecting the rotational speed of the reduction gear shaft 9 and hence that of the photosensitive drum 100. A value of the rotational speed of the photosensitive drum 100 detected by the rotary encoder 11 is used, e.g. for calculating assist torque.

The photosensitive drum 100 is provided with, as control components therefor, a host CPU 1, a controller 2, a motor driver IC 3, a drive circuit 4, a rotational position sensor 6, and a brushless DC motor 5 as a first drive source. The host CPU 1 controls the whole image formation process, and at the start of a normal print operation, issues commands for causing components associated with respective operations from sheet feed to sheet discharge and components associated with the image formation process to operate according to a predetermined sequence. More specifically, during printing operation, the host CPU 1 delivers, at predetermined times, various command values, such as a target speed, PID parameter settings, and a drive start signal, to the controller 2. In response to the command values input from the host CPU 1, the controller 2 starts driving control by speed feedback control such that the rotational speed of the photosensitive drum 100 detected by the rotary encoder 11 disposed on the reduction gear shaft 9 becomes equal to the target speed. The speed feedback control is implemented by PID control comprising proportional control, differential control, and integral control. According to the target speed instructed by the host CPU 1, constant speed control is executed such that the rotational speed of the reduction gear shaft 9 is controlled to the target speed by using the properly designed gains for computations for the respective proportional control, differential control, and integral control. Various signals output from the controller 2 are designed as desired according to the specifications of the motor driver IC 3. In the present embodiment, typical drive control signals are, for example, a drive enable signal, a rotational direction command signal, and a PWM signal.

The drive enable signal is for enabling or disabling the motor driver IC 3. The rotational direction command signal is for setting a rotational direction of the brushless DC motor 5. The PWM signal is a pulse width modulation signal in the form of a rectangular wave signal output to the motor driver IC 3 at a predetermined repetition period, which adjusts phase current flowing through the brushless DC motor 5 based on a duty factor determined by duration of a high-level period of the rectangular wave signal (high-level period/PWM repetition period). As the duty factor is larger, the amount of current flowing through each of phase windings becomes larger, and as the former is smaller, the latter becomes smaller. Here, the magnitude of phase current (current flowing through each phase winding) is equivalent to torque generated by the brushless DC motor 5. Further, the phase current can by adjusted by the duty factor. Therefore, it is possible to regard the duty factor as torque generated by the brushless DC motor 5.

The drive circuit 4 is for supplying drive current to the phase windings of the brushless DC motor 5, and is a full-bridge circuit composed of a plurality of FETs (field effect transistors). The motor driver IC 3 sequentially turns on and off the FETs of the drive circuit 4, whereby the phase currents are caused to flow through the brushless DC motor 5 sequentially, such that rotational torque is generated in a desired rotational direction. Note that the timings for turning on and off each FET are properly set by the motor driver IC 3 based on rotor rotational position information on the brushless DC motor 5 input from the rotational position sensor 6. The photosensitive drum 100 is rotated by torque transmitted from the brushless DC motor 5 to the reduction gear shaft 9 via meshing between the motor shaft gear 7 and the reduction gear 8.

Figure 3:
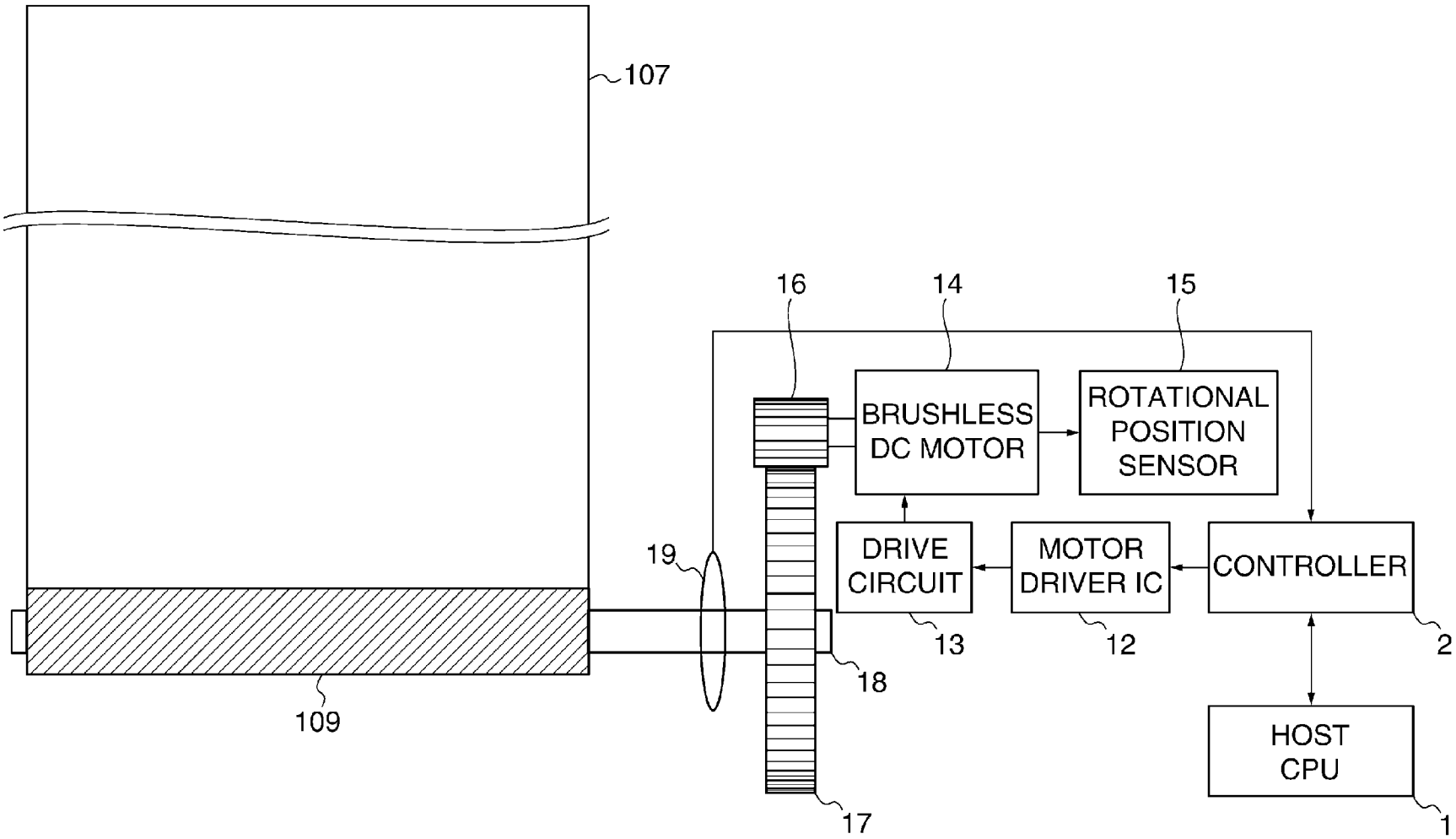
FIG. 3 is a schematic diagram showing the electrical and mechanical arrangement for driving an intermediate transfer belt appearing in FIG. 1.

FIG. 3 is a schematic diagram showing the electrical and mechanical arrangement for driving the intermediate transfer belt 107 appearing in FIG. 1.

Referring to FIG. 3, the intermediate transfer belt 107 is driven by driving the stretching roller (hereafter also referred to as the ITB (intermediate transfer belt) drive roller) 109 disposed in contact with the inside of the intermediate transfer belt 107, for rotation. The ITB drive roller 109 has a roller shaft 18 which is engaged with a motor shaft gear 16 via a reduction gear 17. The roller shaft (ITB roller shaft) 18 of the ITB roller 109 and the reduction gear 17 are fixedly connected to each other by a joint, not shown. The ITB roller shaft 18 has a rotary encoder 19 provided thereon as a second speed detection unit for detecting the rotational speed of the ITB drive roller 109.

The intermediate transfer belt 107 is provided with, as control components therefor, the host CPU 1, the controller 2, a motor driver IC 12, a drive circuit 13, a rotational position sensor 15, and a brushless DC motor 14. The intermediate transfer belt 107 is driven by speed feedback control based on a detection value output from the rotary encoder 19. Note that the speed feedback control is executed by PID control such that the difference between the target process speed instructed by the host CPU 1 and a value of the process speed obtained by converting the detection value from the rotary encoder 19 to the process speed is reduced.

Driving force from the brushless DC motor 14 as a second drive source for driving the intermediate transfer belt 107 is, similarly to the case of the photosensitive drum 100, transmitted via the roller shaft 18 to the ITB drive roller 109 while being reduced in speed by meshing between the motor shaft gear 16 and the reduction gear 17. The electrical arrangement is similar to that of the photosensitive drum shown in FIG. 2.

Next, a description will be given of the internal configuration of the controller 2 appearing in FIGS. 2 and 3.

Figure 4:
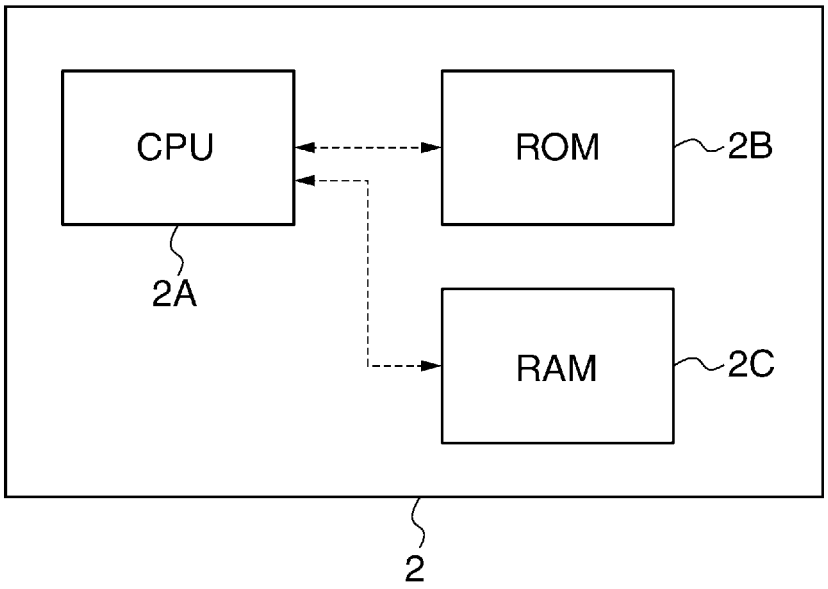
FIG. 4 is a schematic block diagram of a controller appearing in FIGS. 2 and 3.

FIG. 4 is a schematic block diagram of the controller appearing in FIGS. 2 and 3.

Referring to FIG. 4, the controller 2 includes a CPU 2A that performs computations, and a ROM 2B storing a controller program, a circumferential speed different zero point-calculating program, and so forth. Further, the controller 2 includes a RAM 2C for temporarily storing detection values output from the rotary encoders 11 and 19, and other results of computations.

Next, a description will be given of details of the speed feedback control executed by the controller 2. The controller 2 performs the speed feedback control by comparing detection values from the rotary encoders 11 and 19 with the target speed as mentioned hereinabove. The setting of the target speed is performed by setting a value of the rotational speed, as a target value, at which the surface speed of the photosensitive drum 100 or the intermediate transfer belt 107 becomes a target speed.

The following is a description of a method of setting the desired target value. First of all, a description will be given of speed detecting configuration of the rotary encoder (11, 19) as the rotational speed detection sensor.

Figure 5A:
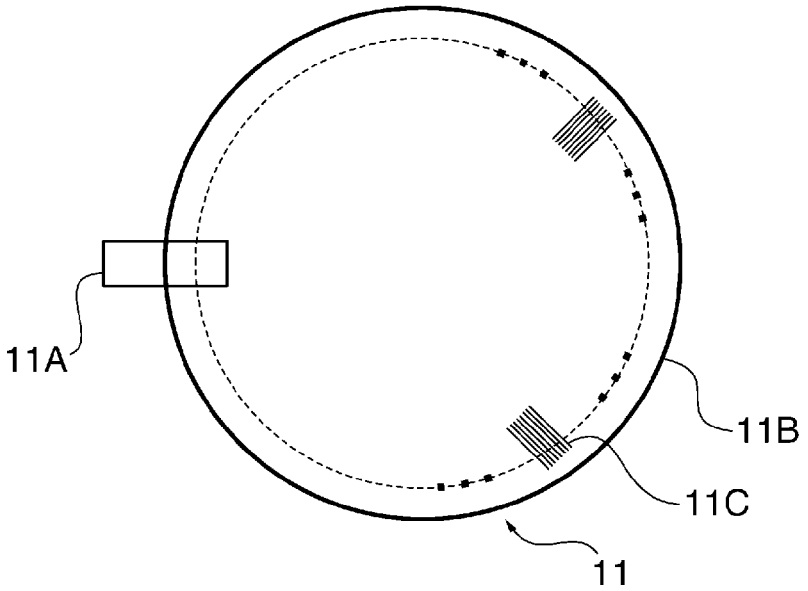
FIGS. 5A and 5B are schematic diagrams useful in explaining the construction of a rotary encoder appearing in FIG. 2.
Figure 5B:
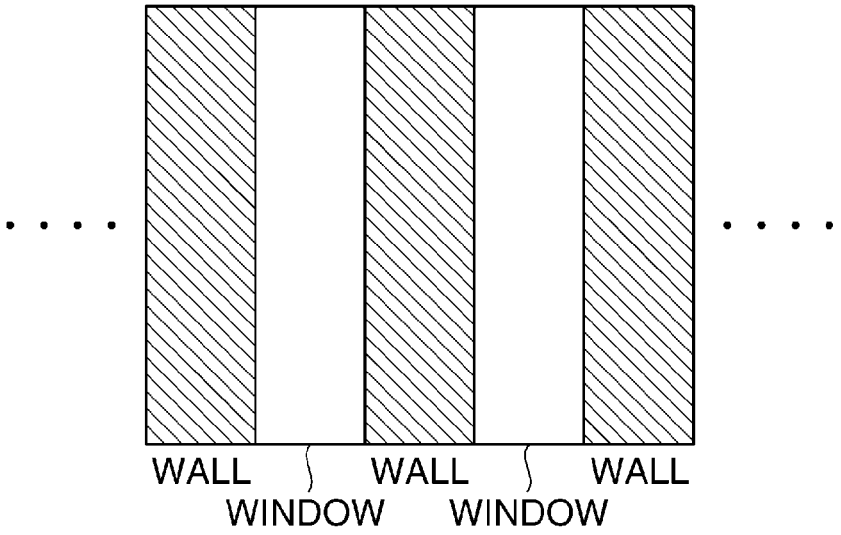

FIGS. 5A and 5B are schematic diagrams useful in explaining the construction of a rotary encoder 11 appearing in FIG. 2. The rotary encoder 11 appearing in FIG. 2 and the rotary encoder 19 appearing in FIG. 3 are configured similarly, and hence the following description is given of the configuration of the rotary encoder 11.

Referring to FIG. 5A, the rotary encoder 11 is mainly composed of a wheel 11B, and a photosensor 11A disposed in a manner opposed to part of a disk-like flat plate of the wheel 11B. The wheel 11B is fixed to the reduction gear shaft 9 of the photosensitive drum 100, and the photosensor 11A is fixed to a supporting member, not shown. The wheel 11B has wheel slits 11C formed therein along the circumference of the disk-like flat plate at equal space intervals.

The principle of detecting rotational speed of the rotary encoder 11 is that the sensor 11A detects wheel slits 11C formed through the periphery of the wheel 11B which is rotated in unison with the drum shaft 10, at equal intervals along the direction of rotation of the wheel 11B. The wheel 11B is in the form of a disk, as mentioned above, and the drum shaft 10 is fixedly fitted through a through hole (not shown) in the center of the disk of the wheel 11B. Although in the present embodiment, the wheel 11B is configured such that it is made of stainless steel, and the slits 11C are formed by forming openings (windows) through the wheel 11B at equal space intervals (FIG. 5B), assuming that the wheel 11B is made of transparent plastic, components corresponding to the slits may be formed by line segments of black ink drawn thereon at equal intervals. Note that the term "slits" refers to a structure in which pairs of a window (opening) and a wall adjacent to the window (opening) are sequentially formed at equal intervals, and the term "the number of slits" refers to the number of pairs of the window (opening) and the wall of the slits 11C.

The sensor 11A has a light emitting section that emits light toward the wheels 11B and a light receiving section that receives the right, and when the light passes through a window of the slits 11C, the light receiving section detects the light, but when the light hits a wall of the slits 11C, the light receiving section does not detect the light. The sensor 11A determines existence of each slit of the slits 11C based on detection of the light by the light receiving section. Therefore, assuming that the number of slits is N, if the rotational speed of the wheel 11B is W rps, the sensor 11A detects a number NW of slits per second.

Hereafter, a description will be given of how the rotational speed (target speed) is set such that the surface speeds of the photosensitive drum 100 and the intermediate transfer belt 107 become a target speed thereof. As mentioned hereinabove, the target speed is set for the surface speed of each of the photosensitive drum 100 and the intermediate transfer belt 107. Hereafter, this surface speed is referred to as "the process speed".

In the speed feedback control in the present embodiment, a target of the process speed (target process speed) is set as a time interval of detection by the rotary encoder. More specifically, assuming, in a case where the surface speed of the photosensitive drum 100 is set to the target process speed, that the target process speed is $V_p$, the number of slits is N, and the radius of the photosensitive drum is $R_d$, a target time interval $T_{TAR}$ of detection of each slit is calculated by the following equation (1):

$$T_{TAR}=2\pi R_d/V_P\cdot N \tag{1}$$

From this, by comparing a time interval value $T_E$ of the time interval detected for one slit with the target time interval $T_{TAR}$, the speed feedback control is performed. Here, a design value is used for the radius $R_d$ of the photosensitive drum. However, this radius can have an error in size, it is very difficult to make the process speed equal to the target process speed $V_P$.

That is, when the speed feedback control is performed by setting the target time interval to $T_{TAR}$, this results in control of the process speed of the photosensitive drum 100 to a speed $V_{PS}$ which is different from $V_P$, as shown in the following equation (2):

$$V_{PS} = \frac{2\times\pi\times(R_d-\Delta R)}{N\times T_{TAR}} \tag{2}$$

Here, a difference $\Delta V_P$ between the target process speed $V_P$ and the actual process speed $V_{PS}$ is calculated by the following equation (3):

$$\Delta V_P = -\frac{2\times\pi\times\Delta R}{N\times T_{TAR}} \tag{3}$$

Figure 6A:
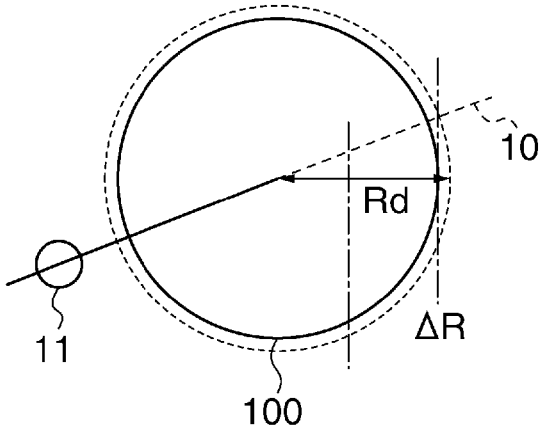
FIGS. 6A and 6B are diagrams useful in explaining a relationship between a target process speed and an actual process speed.
Figure 6B:
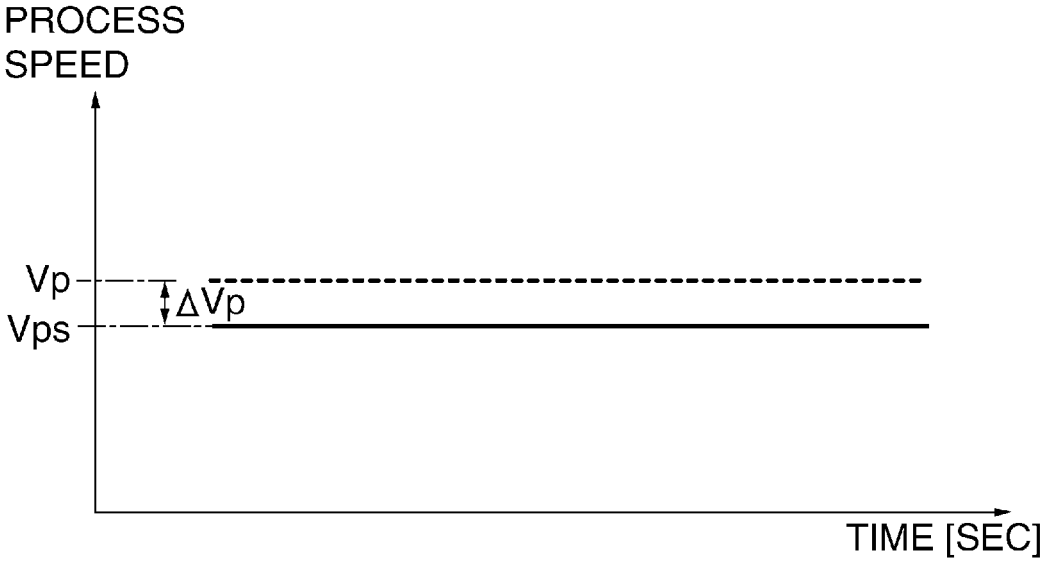

The relationship between the target process speed $V_P$ and the actual process speed $V_{PS}$ is shown in FIGS. 6A and 6B.

FIGS. 6A and 6B are diagrams useful in explaining the relationship between the target process speed $V_P$ and the actual process speed $V_{PS}$.

FIG. 6A shows the photosensitive drum 100 and the rotary encoder 11 disposed on the drum shaft 10, and the radius $R_d$ (design value) of the photosensitive drum 100 is represented by a circle of broken line and the actual radius ($R_d$–ΔR) is represented by a circle of solid line. Further, FIG. 6B shows the process speed $V_P$ to be realized assuming that the speed feedback control is executed by the design value, and the actual process speed $V_{PS}$ actually obtained due to the radius error of the photosensitive drum.

Thus, when the speed feedback control is performed using the design value of the radius of the photosensitive drum, the process speed is controlled to a value which is different from the target process speed intended by the control. As to the intermediate transfer belt 107 as well, the same problem is expected due to an error in the radius of the ITB drive roller 109, accuracy variation in the thickness of the intermediate transfer belt 107, and so forth. Thus, even if an attempt is made to control the photosensitive drum 100 and the intermediate transfer belt 107 to the same process speed, they are both eventually controlled to respective different process speeds due to dimensional errors, accuracy variations, and so forth. As a consequence, there arises a difference between the process speed of the photosensitive drum 100 and that of the intermediate transfer belt 107 at the primary transfer section. This difference in the process speed between the photosensitive drum 100 and the intermediate transfer belt 107 is referred to as the circumferential speed difference.

In the present embodiment, a target detection time interval $T_{TAR_R}$ at which the circumferential speed difference between the photosensitive drum 100 and the intermediate transfer belt 107 becomes zero is calculated, and then the circumferential speed difference is set to an optimum value, whereby the transferability at the primary transfer section is stabilized.

First, a description will be given of a method of calculating the target detection time interval $T_{TAR_R}$ of the rotary encoder 11 at which the circumferential speed difference becomes zero. The calculation of the target detection time interval $T_{TAR_R}$ at which the circumferential speed difference becomes zero is performed by reading a detection value of the rotary encoder 11 when the photosensitive drum 100 is driven while being subjected to friction driving by the intermediate transfer belt 107. Note that friction driving is realized by a frictional force acting between contact portions of the surface of the photosensitive drum 100 and that of the intermediate transfer belt 107 at the primary transfer section (hereinafter referred to as "the transfer section frictional torque") and control of rotational torque of the photosensitive drum 100. At this time, the intermediate transfer belt 107 is subjected to speed feedback control to the target process speed (the target process speed of the intermediate transfer belt 107 is hereinafter referred to as "the ITB target process speed").

Hereafter, a description will be given of details of the principle for realizing the friction driving.

Figure 7:
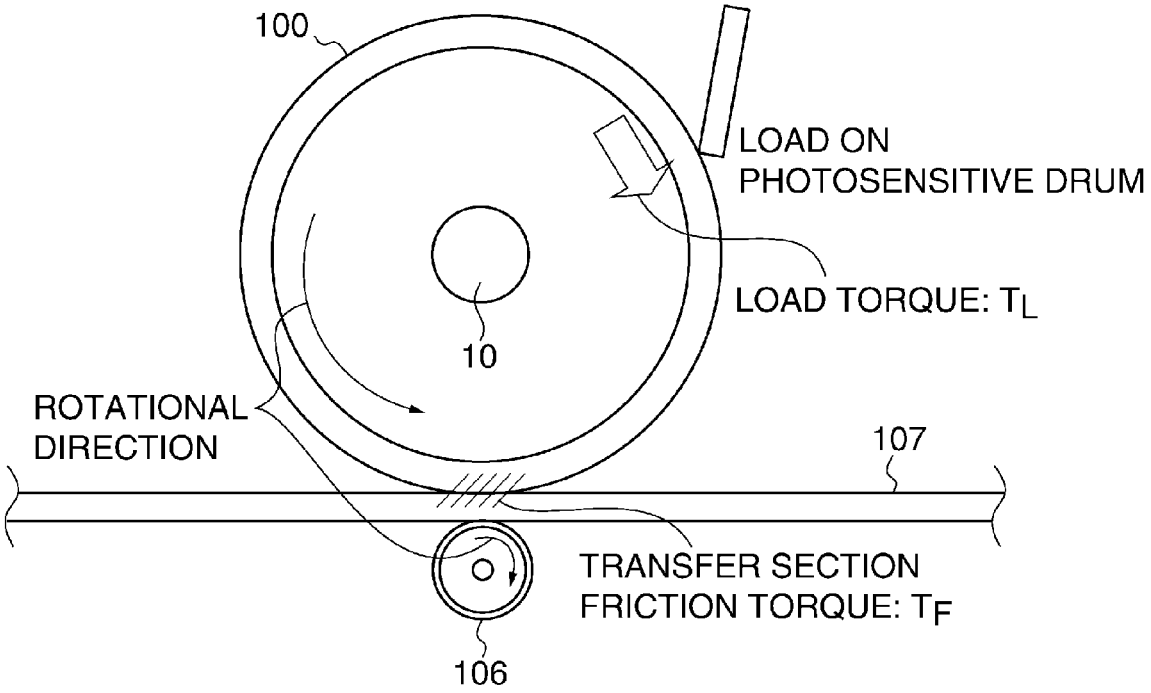
FIG. 7 is a diagram useful in explaining load torque on a drum shaft and transfer section friction torque, which are generated when the photosensitive drum is driven at a predetermined process speed.

FIG. 7 is a diagram useful in explaining load torque on the drum shaft 10 and transfer section friction torque, which are generated when the photosensitive drum 100 is driven at a predetermined process speed.

Referring to FIG. 7, one surface of the intermediate transfer belt 107 is in contact with the photosensitive drum 107, whereby a friction drive section is formed. Note that it is assumed that the transfer section friction torque is obtained by converting a frictional force acting at the primary transfer section to torque of the drum shaft 10 which is the rotational shaft of the photosensitive drum 100. The photosensitive drum 100 has load torque $T_L$ always generated thereon in a direction opposite to the rotational direction, by frictional forces generated by the cleaner blade 104, a bearing of the drum shaft 10, etc. The load torque $T_L$ does not include the transfer section friction torque $T_F$.

The load torque $T_L$ is much larger than the maximum value $T_{FMAX}$ of the transfer section friction torque $T_F$ (i.e. $T_L \gg T_{FMAX}$), and hence the photosensitive drum 100 cannot be friction-driven by the transfer section friction torque alone.

Figure 8:
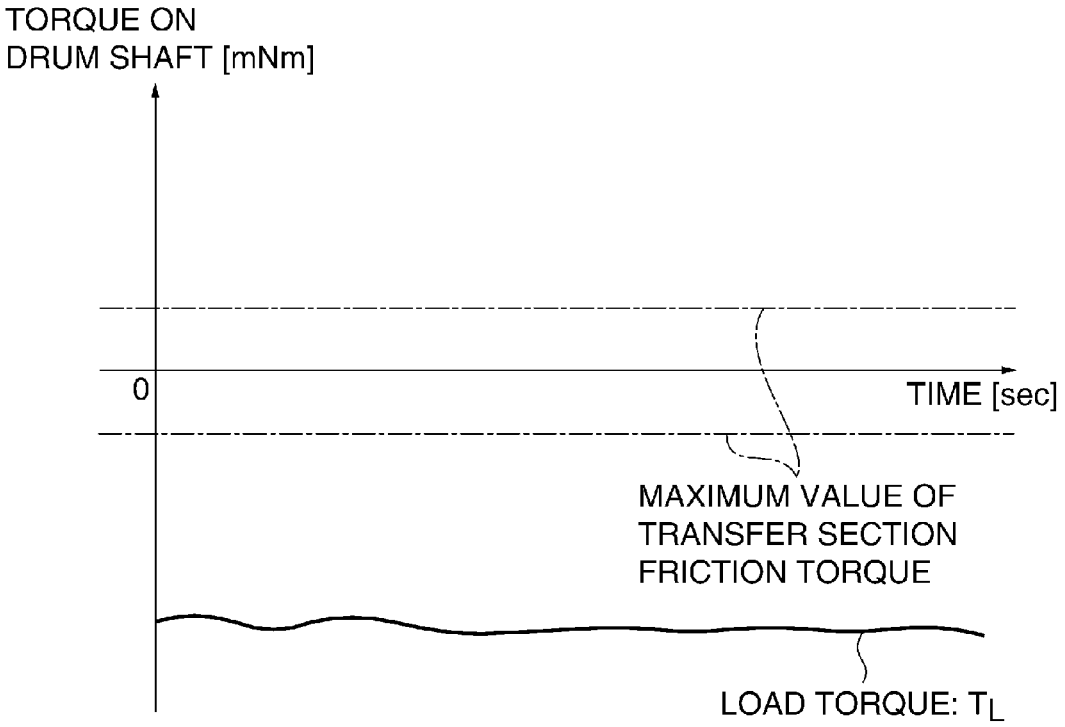
FIG. 8 is a diagram showing a relationship between transient changes in load torque on the drum shaft during an image formation process and maximum values of transfer section friction torque.

FIG. 8 is a diagram showing a relationship between transient changes in load torque on the drum shaft 10 during the image formation process and the maximum values of the transfer section friction torque.

As shown in FIG. 8, the load torque $T_L$ is not always constant, but undergoes transient changes depending on a timing at which a high charge voltage is applied, a timing at which remaining toner which has not been transferred enters the cleaner 104, and the like. However, it is known that this transient change component (hereinafter referred to as the "varying torque component") is sufficiently small with respect to the load torque $T_L$ which is constantly generated. In view of this, by applying the same amount of rotational torque as that of a DC-like component of the load torque $T_L$ to the photosensitive drum 100 using the brushless DC motor 5 as a rotational torque generation unit, it is possible to offset the DC-like component of the load torque $T_L$ generated on the photosensitive drum 100. Rotational torque thus applied to the photosensitive drum 100 to offset the load torque $T_L$ is referred to as the assist torque.

Figure 9:
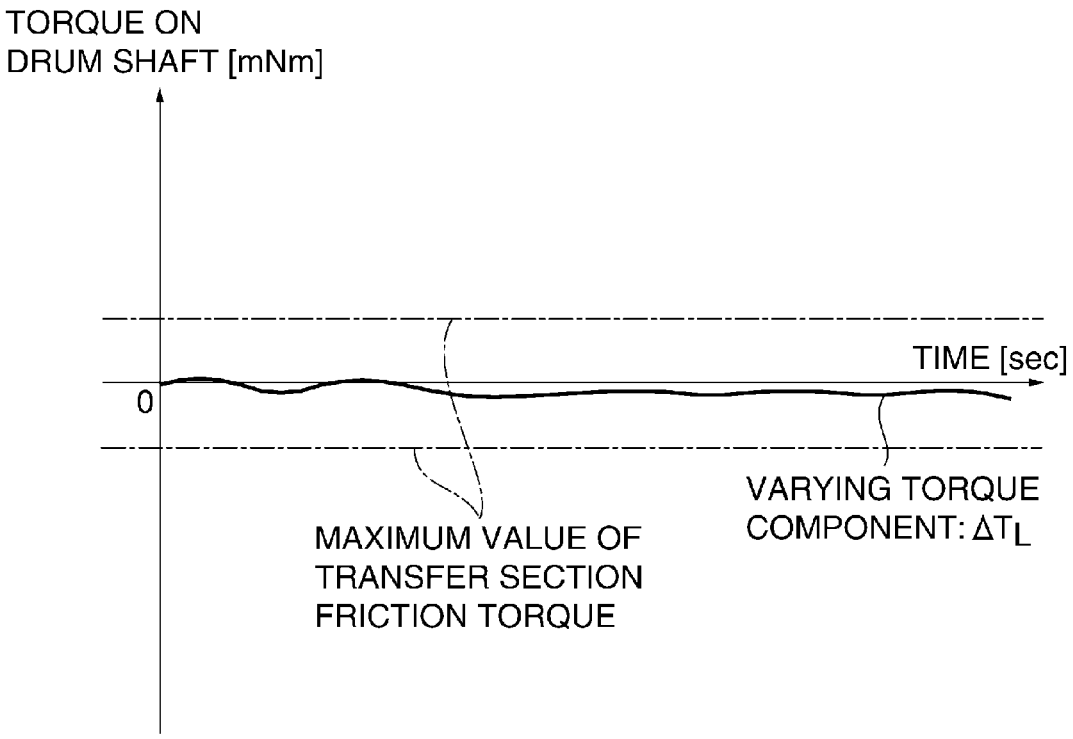
FIG. 9 is a diagram showing a state in which the load torque on the drum shaft shown in FIG. 7 is offset by assist torque.

FIG. 9 is a diagram showing a state in which the load torque $T_L$ on the drum shaft shown in FIG. 7 is offset by the assist torque.

Referring to FIG. 9, there are shown transient changes of torque of the drum shaft 10. More specifically, the constant component of the load torque $T_L$ is offset by the assist torque given to the photosensitive drum 100, whereby substantially only the varying torque component $\Delta T_L$ alone is acting. As shown in FIG. 9, if the varying torque component, which undergoes AC-like variation, is not larger than the maximum value ($T_{FMAX}$) of the transfer section friction torque, it is possible to cause the photosensitive drum 100 to be friction-driven by the intermediate transfer belt 107.

However, the photosensitive drum 100 is required to be rotated in a manner following up AC-like changes in the speed of the intermediate transfer belt 107. In the present embodiment, acceleration torque represented by a multiplication product of a drum inertia and an acceleration of the drum shaft 10 of the photosensitive drum 100 is also taken into account.

More specifically, the friction driving in which the photosensitive drum 100 is friction-driven by the intermediate transfer belt 107 is realized on condition that the sum of the acceleration torque of the photosensitive drum 100 and the varying torque component, and the friction torque $T_F$ between the photosensitive drum 100 and the intermediate transfer belt 107 always satisfy the following expressions (4) and (5) of motion:

$$|T_{FMAX}| \geq J \times d\omega/dt + T_L - T_{AS} \quad (4)$$

$$|T_{FMAX}| \geq J \times d\omega/dt + \Delta T_L \quad (5)$$

wherein $T_{FMAX}$ represents the maximum transfer section friction torque, J equivalent moment of inertia of the drum shaft 10, dω/dt the angular acceleration, $T_L$ the load torque, $T_{AS}$ the assist torque, and $\Delta T_L$ the varying torque component. Note that absolute value signs are added around $T_{FMAX}$ because the maximum transfer section friction torque includes respective torques acting in rotational directions opposite to each other, and one of them is indicated by a positive value, the other is indicated by a negative value.

The expressions (4) and (5) indicate that the same amount of rotational torque as that of the DC-like component of the load torque $T_L$ is generated as the assist torque $T_{AS}$ in a direction opposite to the load torque, whereby the amount of transfer section friction torque $T_F$ required to be applied is reduced to a range within the maximum transfer section friction torque $T_{FMAX}$. Further, the above expressions (4) and (5) also indicate that the friction driving can be performed on condition that the sum of the acceleration torque (J×dω/dt) and the varying torque component $\Delta T_L$ of the photosensitive drum 100 is always within the maximum transfer section friction torque $T_{FMAX}$. The acceleration torque (J×dω/dt) is expressed by the multiplication product of the equivalent moment of inertia (J) of the drum shaft (hereafter, referred to as "the equivalent drum inertia") and the angular speed (dω/dt) of the photosensitive drum 100. Note that the angular speed (dω/dt) of the photosensitive drum 100 is a value determined based on a surface speed varying component of the intermediate transfer belt 107 detected at the primary transfer section. Further, the equivalent drum inertia (J) expresses all rotating loads as the inertia component of the drum shaft 10.

Figure 10:
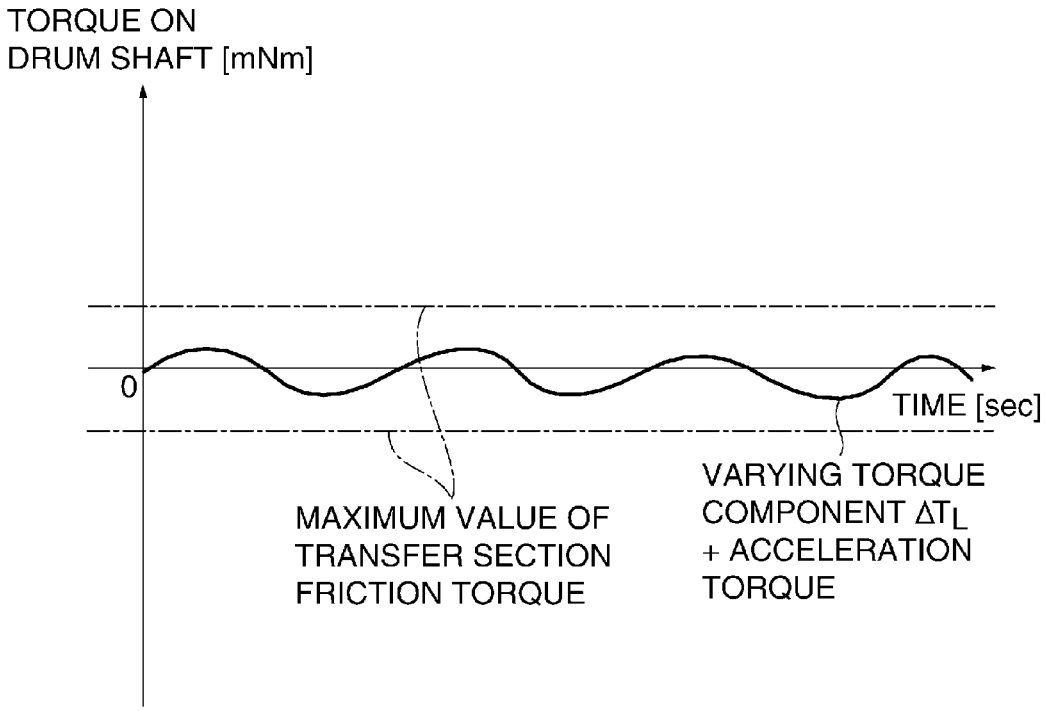
FIG. 10 is a diagram showing a relationship between changes with time in load torque as the sum of acceleration torque and a varying torque component on the photosensitive drum appearing in FIG. 7, and the maximum values of the transfer section friction torque.

FIG. 10 is a diagram showing a relationship between changes with time in load torque as the sum of the acceleration torque and the varying torque component of the photosensitive drum appearing in FIG. 7 and the maximum value $T_{FMAX}$ of the transfer section friction torque. In FIG. 10, the sum of the varying torque component $\Delta T_L$ and the acceleration torque is always smaller than the maximum value $T_{FMAX}$ of the transfer section friction torque $T_F$.

Basically, the varying torque component $\Delta T_L$ can be regarded as a negligibly small one. Therefore, to increase the friction driving capability (followability) by torque other than the assist torque $T_{AS}$, it is envisaged to increase the maximum transfer section friction torque $T_{FMAX}$ or reduce the acceleration torque. It is not easy to change the maximum transfer section friction torque $T_{FMAX}$ because the maximum transfer section friction torque $T_{FMAX}$ is closely associated with the toner transfer process in the primary transfer. On the other hand, reduction of the acceleration torque (J×dω/dt) can be relatively easily realized by reducing the equivalent drum inertia (J). An inertia component of the brushless DC motor 5 appearing on the drum shaft 10 is largely influenced by a gear ratio between the reduction gear 8 and the motor shaft gear 7, and is represented by a value obtained by multiplying the motor shaft inertia by the square of the gear ratio. Therefore, the inertia of a rotor of the brushless DC motor 5 becomes much larger than the inertia component of the photosensitive drum 100 acting on the drum shaft 10. To cope with this, the brushless DC motor 5 in the present embodiment employs a low-inertia brushless DC motor of an inner-rotor type. This makes it possible to largely reduce the equivalent drum inertia, and as a result, the acceleration torque is also largely reduced.

As described above, by offsetting the DC-like component of the load torque on the drum shaft 10 by applying the assist torque, and also by selecting the low-inertia motor, it is fully possible to cause the photosensitive drum 100 to be friction-driven by the intermediate transfer belt 107 using the transfer section friction torque. Although in the present embodiment, the drum brushless DC motor 5 is used as a generation source of the assist torque, this is not limitative, but any other component may be employed insofar as it is capable of generating constant torque.

Next, a description will be given of a method of detecting a state in which the circumferential torque difference between the photosensitive drum 100 and the intermediate transfer belt 107 is made equal to zero by adjusting the assist torque.

Figure 11:
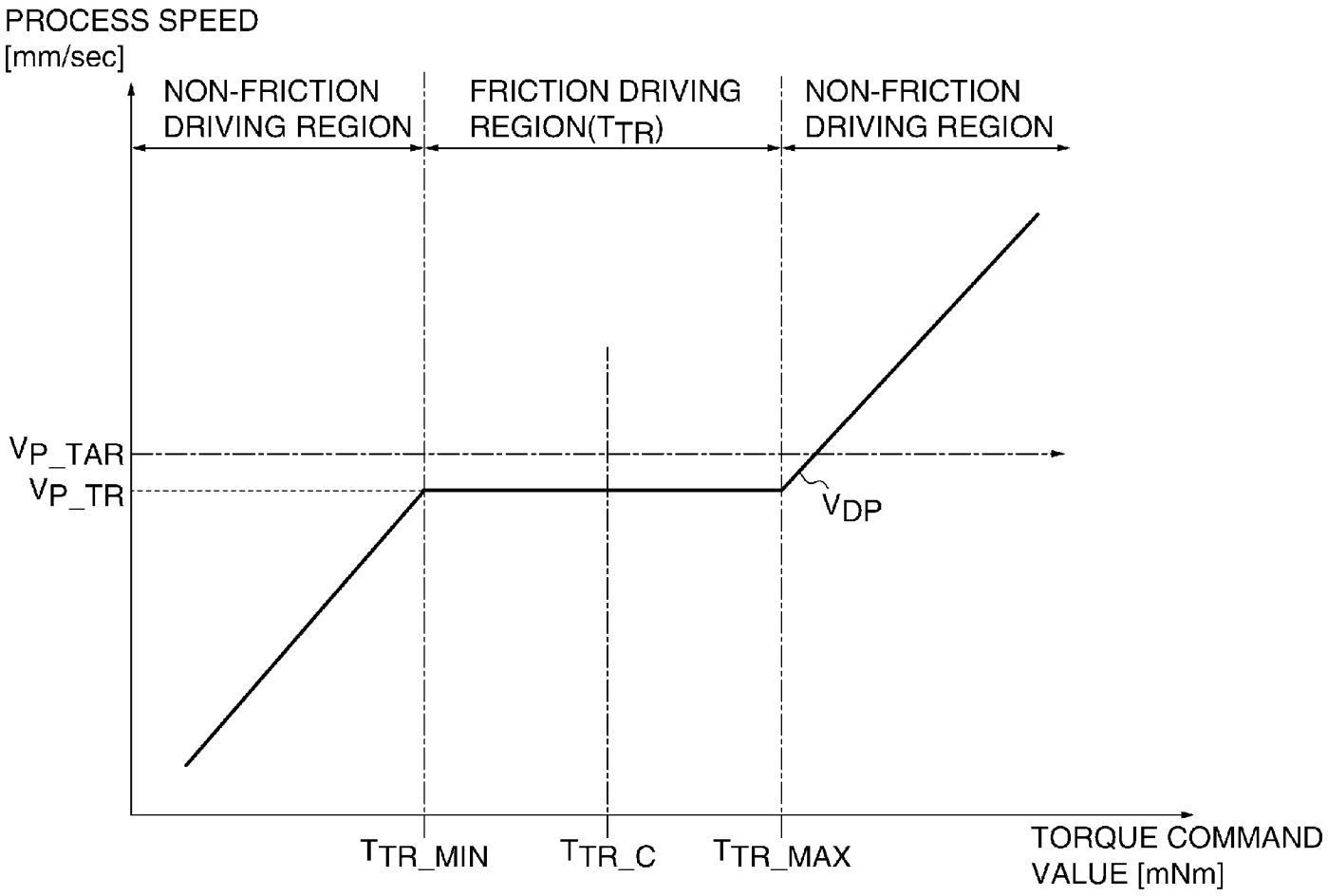
FIG. 11 is a line graph showing a relationship between a torque command value set for rotating the photosensitive drum and a process speed of the photosensitive drum.

First, in a state in which a predetermined contact pressure is applied between the photosensitive drum 100 and the intermediate transfer belt 107 at the primary transfer section, the controller 2 causes the photosensitive drum 100 to be rotated by fixed assist torque while controlling the intermediate transfer belt 107 to the ITB target process speed by the speed feedback control. In doing this, it is assumed that the fixed assist torque initially given such that the photosensitive drum 100 is stably rotated is determined in advance such that the process speed of the photosensitive drum 100 obtained by the fixed assist torque is slower than the target process speed of the intermediate transfer belt 107. FIG. 11 shows a manner of changing the setting value of the fixed assist torque thereafter such that it is progressively increased in steps.

FIG. 11 is a line graph showing a relationship between a torque command value output so as to give the above-mentioned fixed assist torque to the photosensitive drum 100 for rotation and the resulting process speed of the photosensitive drum 100.

Referring to FIG. 11, a line in the line graph is formed by issuing a torque command value which gives the fixed assist torque to the photosensitive drum 100, plotting an average value of values of the process speed each obtained by converting respective detection values (detection time intervals) output from the rotary encoder 11 according to the torque command value for at least one revolution of the drum shaft 10, and connecting average values thus plotted on the graph by progressively increasing the torque command value. Here, it is desirable that when calculating each average value of the process speed $V_{DP}$, the photosensitive drum 100 is rotated through not less than one revolution. Load torque $T_L$ on the photosensitive drum 100 is not constant as an instantaneous value, but can be regarded to be constant for approximately one revolution of the photosensitive drum 100. Further, the measurement system of the rotary encoder 11 is not free from a problem of measurement accuracy, and hence the measurement accuracy is lower as for instantaneous values.

In FIG. 11, normally, as the torque command value corresponding to the assist torque given to the photosensitive drum 100 is increased, the process speed is increased as a matter of course. However, since the photosensitive drum 100 is in contact with the intermediate transfer belt 107, there is a region ($T_{TR}$) having no change in the process speed even though the torque command value is increased. This region is a friction driving region. In FIG. 11, the process speed of the photosensitive drum 100 is indicated by $V_{P_TR}$ and the ITB target process speed to which the intermediate transfer belt 107 is controlled by speed feedback control is indicated by $V_{P_TAR}$.

At this time, a minimum torque command value $T_{TR_MIN}$ and a maximum torque command value $T_{TR_MAX}$, associated with the friction driving region, correspond to the above-mentioned maximum values of the transfer section friction torque. Further, a torque command value for optimum assist torque corresponds to a point at which the range defined by the maximum values of the transfer section friction torque is divided into positive and negative ranges, where the friction torque is ±0. That is, as the torque command value is shifted closer to the torque command value $T_{TR_MIN}$ or $T_{TR_MAX}$ from the center as the point where the friction torque is ±0, the magnitude of the friction torque becomes larger (although the direction of the friction torque is opposite). Further, when the torque command value exceeds the friction driving region, the region changes to a non-friction driving region, where a dynamic friction coefficient becomes dominant, and the friction torque suddenly drops. Therefore, a median value between these two torque command values $T_{TR_MIN}$ and $T_{TR_MAX}$ where the surface speed of the photosensitive drum 100 starts to change in response to the torque command value is the optimum assist torque $T_{TR_C}$.

In the present embodiment, it is possible to vary the rotational torque of the photosensitive drum 100 (generated torque variable unit), and measure the friction driving region shown in FIG. 11 by varying the rotational torque, and determine a center of the friction driving region by a circumferential speed difference zero point-calculating process described hereinafter. Then, a detection value (detection time interval $T_E$) which is output from the rotary encoder 11 when the assist torque (torque command value) is in the thus-determined center of the friction driving region is calculated as a target detection time interval $T_{TAR_R}$.

Hereafter, a description will be given of a process for calculating the target detection time interval $T_{TAR_R}$. Note that for convenience of description, the process for calculating the target detection time interval $T_{TAR_R}$ is hereafter referred to as "the circumferential speed difference zero point-calculating process". The circumferential speed difference zero point-calculating process is performed by a program stored in the ROM 2B, which is executed by the CPU 2A of the controller 2 having received a circumferential speed difference zero point calculation command from the host CPU 1.

Figure 12:
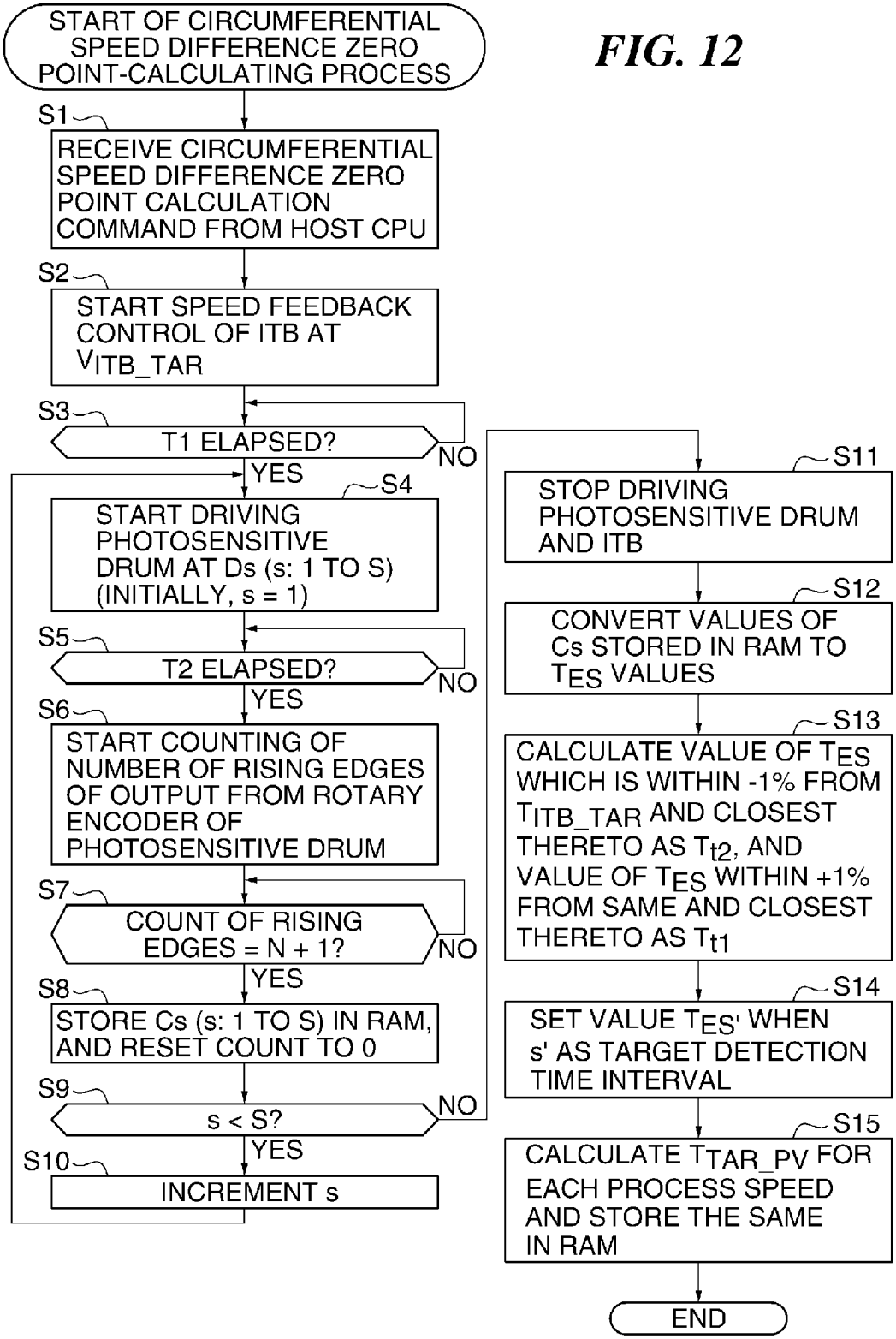
FIG. 12 is a flowchart of a circumferential speed difference zero point-calculating process by the image forming apparatus shown in FIG. 1.

FIG. 12 is a flowchart of the circumferential speed difference zero point-calculating process executed by the image forming apparatus shown in FIG. 1.

The circumferential speed difference zero point-calculating process is started by the CPU 2A upon receipt of the circumferential speed difference zero point calculation command from the host CPU 1 (step S1). Then, the CPU 2A starts driving the roller shaft 18 by the speed feedback control such that the surface speed of the intermediate transfer belt 107 becomes a predetermined process speed $V_{ITB_TAR}$ (step S2). Next, the CPU 2A waits for a predetermined time period T1 to elapse from the start of driving the roller shaft (step S3), and after the lapse of the predetermined time period T1, the CPU 2A starts driving of the photosensitive roller 100 by a PWM signal having a fixed duty factor (corresponding to the aforementioned torque command value, and hence to the fixed assist torque) ($D_s$ (s: 1 to S)) (step S4). Here, s represents a number assigned to each setting value of the duty factor. For example, numbers s of 1 to S are assigned to respective S setting values of the duty factor, and data of the numbers s assigned to the setting values of the fixed duty factor is stored in the ROM 2B in advance. A setting value of the fixed duty factor applied when the present process is initially started is determined by s, and the fixed duty factor associated with s=1 is represented by D1. Further, the process speed of the photosensitive drum 100 driven at the fixed duty factor D1 is a design value set in advance such that it is −1% or more smaller than the process speed $V_{ITB_TAR}$ of the intermediate transfer belt 107.

Next, the CPU 2A waits for a predetermined time period T2 (step S5), and thereafter, starts counting the number of rising edges of the detection signal output from the rotary encoder 11, by an internal counter of the CPU 2A (step S6). Here, the predetermined time period T2 is set to a time period required for the rotational speed of the photosensitive drum 100 to become a stable constant speed after the start of driving the same.

Then, the CPU 2A determines whether or not the count of rising edges has reached N+1 (step S7). When the count of rising edges has reached N+1, the CPU 2A latches a value of the internal counter to store the latched value as $C_S$, in the RAM 2C, and then resets the internal counter to zero (step S8). The symbol N represents the number of slits of the rotary encoder 11, as mentioned hereinabove. Therefore, when the count ($C_S$) of the internal counter obtained when a number N+1 of rising edges are counted is equivalent to a time period over which the photosensitive drum 100 rotates through one revolution.

Next, the CPU 2A determines whether or not the current setting value s is smaller than the number S of times of measurement (step S9). Then, if the answer to this question is affirmative (YES), the CPU 2A increments the value of S by 1 to thereby set the fixed duty factor again to a setting having the incremented value, and then returns to the step S4 (step S10) to repeat the steps S4 to S9.

On the other hand, if the answer to the question of the step S9 is negative (NO), the CPU 2A stops driving the photosensitive drum 100 and the intermediate transfer belt 107 (step S11).

Next, the CPU 2A converts the value $C_S$ of each count stored in the RAM 2C to a detection time interval $T_{ES}$ at which one slit of the rotary encoder is detected (step S12). This conversion is performed by the following equation (6):

$$T_{ES} = \frac{C_S \times t_c}{N} \tag{6}$$

wherein $t_c$ is a clock period of the internal counter.

Next, the CPU 2A determines, as a value $T_{t1}$, a value of $T_{ES}$ which is within +1% with respect to the target detection time interval $T_{ITB_TAR}$ calculated from the ITB target process speed of the intermediate transfer belt 107, and is closest thereto, and as a value $T_{t2}$, a value of $T_{ES}$ which is within −1% with respect to the same, and closest thereto (step S13). Then, the CPU 2A sets the target detection time interval $T_{TAR_R}$ to a detection time interval $T_{ES'}$ associated with a setting value s' of the duty factor calculated by $[(T_{t1}-T_{t2})/2+T_{t2}]$ (step S14).

After setting the target detection time interval $T_{TAR_R}$, the CPU 2A sets a desired circumferential speed difference associated with a process speed by the following equation (7), and stores the calculated target detection time interval $T_{TAR_PV}$ having the circumferential speed difference set thereto, in the RAM 2C (step S15):

$$T_{TAR_PV} = \frac{T_{ES'}(1 - P_{PV}/100)}{T_{ITB_TAR}} \times T_{PV} \tag{7}$$

wherein $T_{TAR_PV}$ represents the target detection time interval having the circumferential speed difference set thereto of the rotary encoder 11, and $T_{PV}$ represents the target detection time interval of the rotary encoder 19 set when the target process speed of the intermediate transfer belt 107 is set.

The target detection time intervals $T_{ITB_TAR}$ and $T_{PV}$ are different in the following respects: $T_{ITB_TAR}$ indicates the target detection time interval set when the intermediate transfer belt 107 is subjected to the speed feedback control during the above-described circumferential speed difference zero point-calculating process, whereas $T_{PV}$ also represents the target detection time interval, but it includes values thereof set for other process speeds. Further, $T_{TAR_PV}$ represents the target detection time interval of the rotary encoder 11 of the photosensitive drum 100 set when the circumferential speed difference with respect to the target process speed of the intermediate transfer belt 107 is zero. $P_{PV}$ represents a value for designating a ratio of the circumferential speed difference, and when the setting value of the process speed of the photosensitive drum 100 is desired to be increased with respect to the process speed of the intermediate transfer belt 107, it is set to a positive value, whereas the same is desired to be reduced, it is set to a negative value. Accordingly, for example, when the driving control is desired to be executed at a circumferential speed difference setting of +1%, a torque command value for driving the drum shaft 10 is set such that the target detection time interval $T_{TAR_PV}$ having the circumferential speed difference set thereto of the rotary encoder 11 becomes equal to a value calculated by the following equation (8):

$$T_{TAR_PV} = \frac{T_{ES'}(1 - 1/100)}{T_{ITB_TAR}} \times T_{PV} \tag{8}$$

Then, a normal printing operation is performed using the set torque command value.

The circumferential speed difference zero point-calculating process is assumed to be executed in an adjustment mode set immediately after the main power of the image forming apparatus 200 is turned on. In the adjustment mode, there are executed adjustment of lots of process controls including temperature adjustment of a fixing roller 113A of the fixing device 113, potential control, automatic registration, voltage value setting for transfer high voltage, etc.

According to the circumferential speed difference zero point-calculating process in FIG. 12, from a detection value output from the rotary encoder 11 in a state where the photosensitive drum 100 is being friction-driven by the intermediate transfer belt 107 via the contact surface of them, a target value is set for making the respective surface speeds of the two equal to each other during normal printing operation. Then, the brushless DC motor 5 is controlled such that the target value is output from the rotary encoder 11. This makes it possible to calculate a speed setting value which makes the circumferential speed difference between the photosensitive drum 100 and the intermediate transfer belt 107 equal to zero, without being affected by lowering of measurement accuracy due to a change in the friction coefficient at the primary transfer section. Therefore, it is possible to stabilize the transferability at the primary transfer section. Further, by setting an appropriate circumferential speed difference with respect to the determined speed setting value, it is possible to further stabilize the transferability.

In the present embodiment, the circumferential speed difference zero point-calculating process starts to be executed in the adjustment mode after adjustment of all process controls is terminated and the photosensitive drum 100 and the intermediate transfer belt 107 are stopped. Although in the present embodiment, the circumferential speed difference zero point-calculating process is executed in the adjustment mode, this is not limitative, but it may be executed e.g. during replacement of a mechanical component, such as the photosensitive drum 100, the intermediate transfer belt 107 or the like.

Next, a second embodiment of the present invention will be described.

Figure 13:
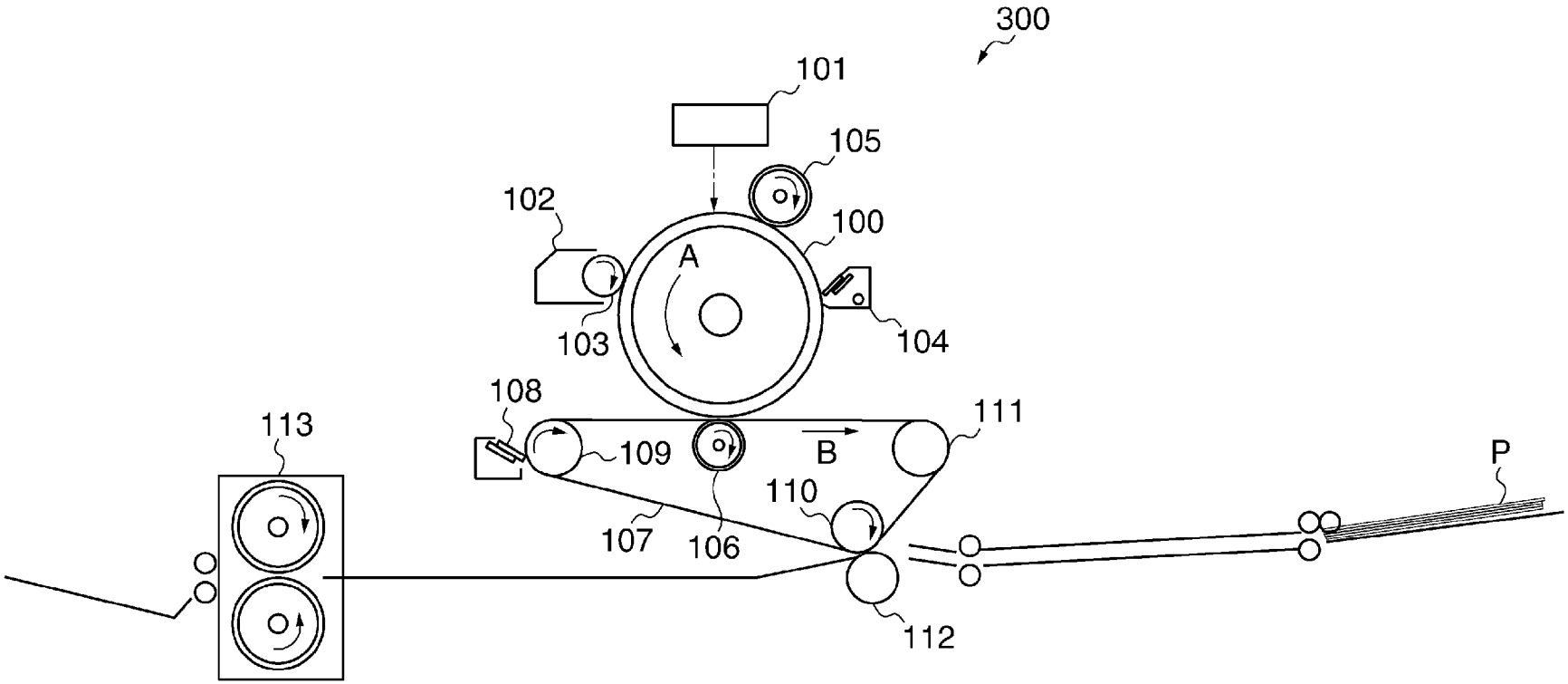
FIG. 13 is a schematic cross-sectional view of an image forming apparatus of one drum type according to a second embodiment of the present invention.

FIG. 13 is a schematic cross-sectional view of an image forming apparatus of one drum type according to the second embodiment. This image forming apparatus, denoted by reference numeral 300, is an electrophotographic monochrome digital copy machine or multifunction peripheral.

The arrangement of the image forming apparatus 300 is the same as that of the FIG. 1 image forming apparatus except that it is one drum type, and hence description of the arrangements, particularly, those for driving the photosensitive drum 100 and the intermediate transfer belt 107 is omitted, with components corresponding to those in the first embodiment being denoted by the same reference numerals (without Y, M, C, K). Further, the image forming apparatus 300 is also the same as the FIG. 1 image forming apparatus in that, during printing operation, the photosensitive drum 100 and the intermediate transfer belt 107 are subjected to the speed feedback control using the rotary encoders 11 and 19.

In the first embodiment, the surface speed of the photosensitive drum 100 is made equal to that of the intermediate transfer belt 107, and the detection value output from the rotary encoder 11 is calculated into the rotational speed setting value at which the circumferential speed difference is zero. In the present embodiment, inversely, the surface speed of the intermediate transfer belt 107 is made equal to that of the photosensitive drum 100, and the detection value output from the rotary encoder 19 is calculated into a rotational speed setting value at which the circumferential speed difference is zero.

Hereafter, a description will be given of a circumferential speed difference zero point-calculating process in the second embodiment.

Figure 14:
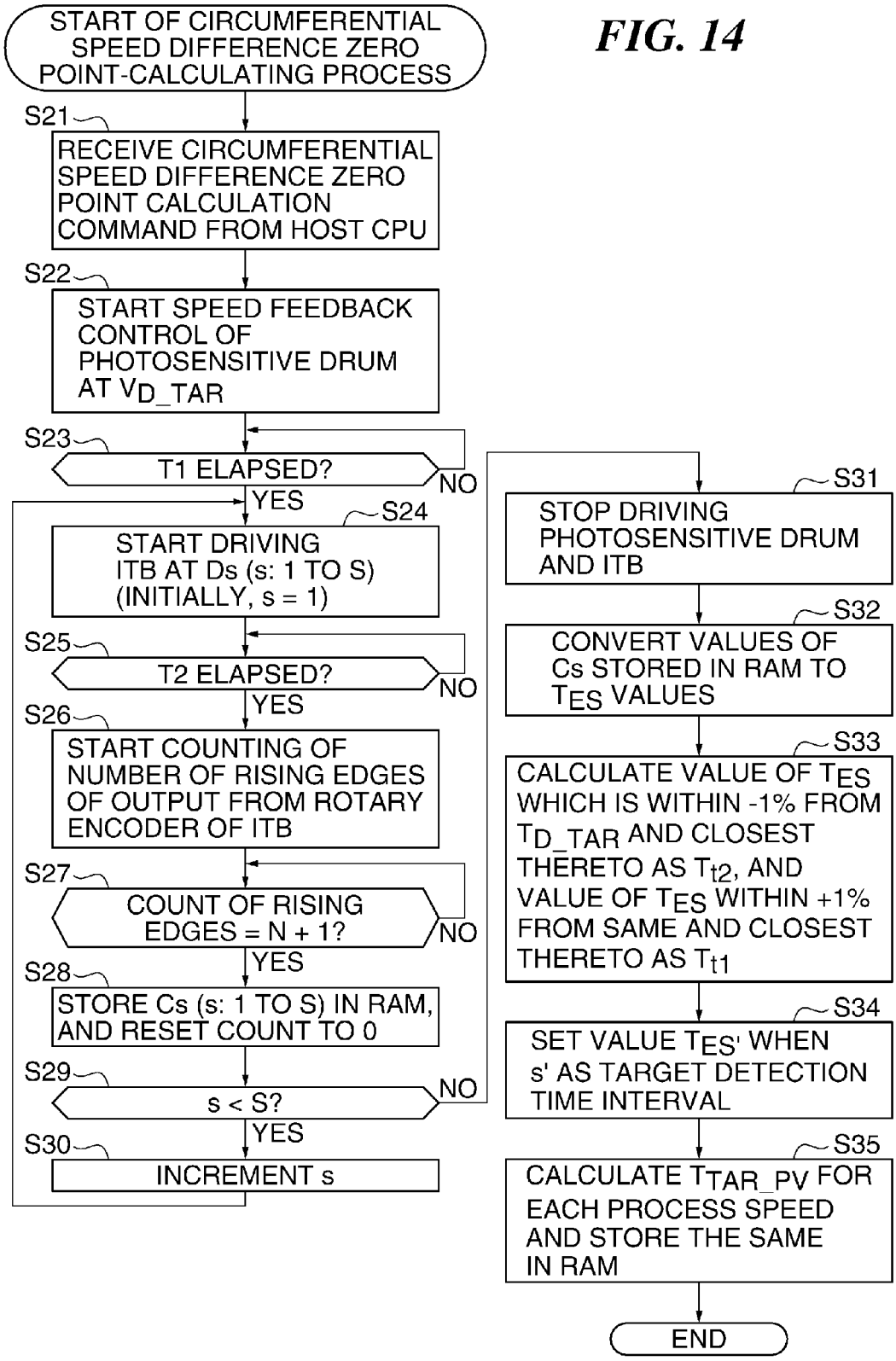
FIG. 14 is a flowchart of a circumferential speed difference zero point-calculating process by the image forming apparatus shown in FIG. 13.
Figure 15A:
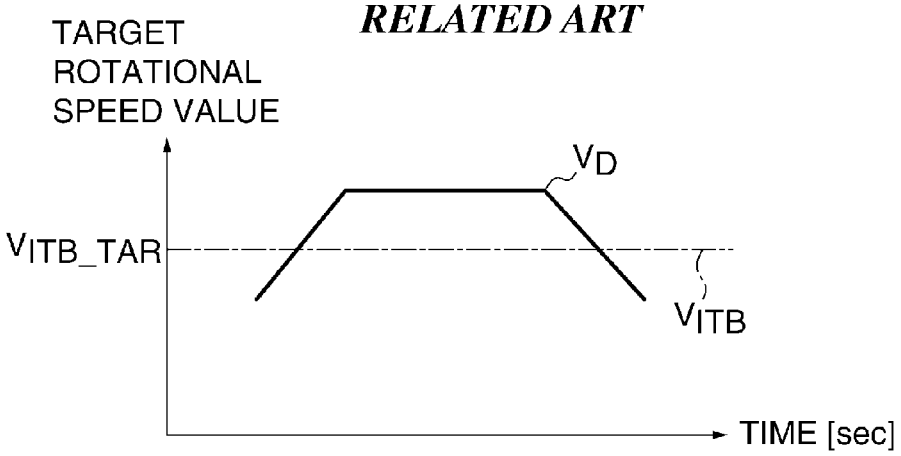
FIG. 15A RELATED ART
FIGS. 15A to 15C are diagrams useful in explaining related art for calculating a rotational speed setting value of a rotary encoder in a case where the circumferential speed difference becomes zero, without using any surface speed sensors.
Figure 15B:
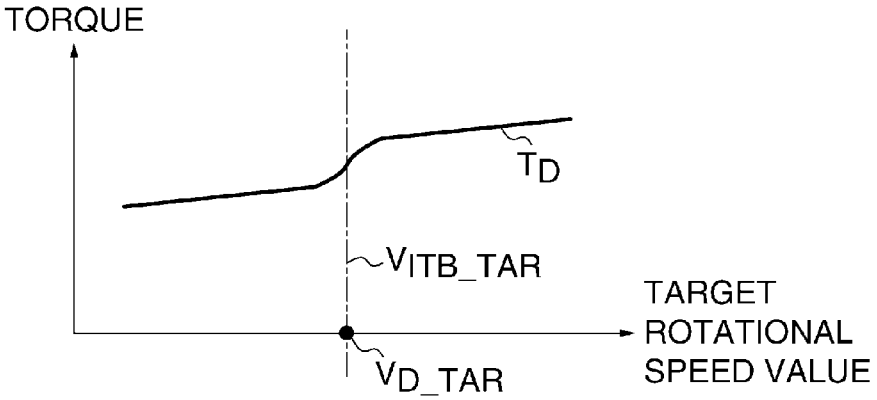
FIG. 15B RELATED ART
Figure 15C:
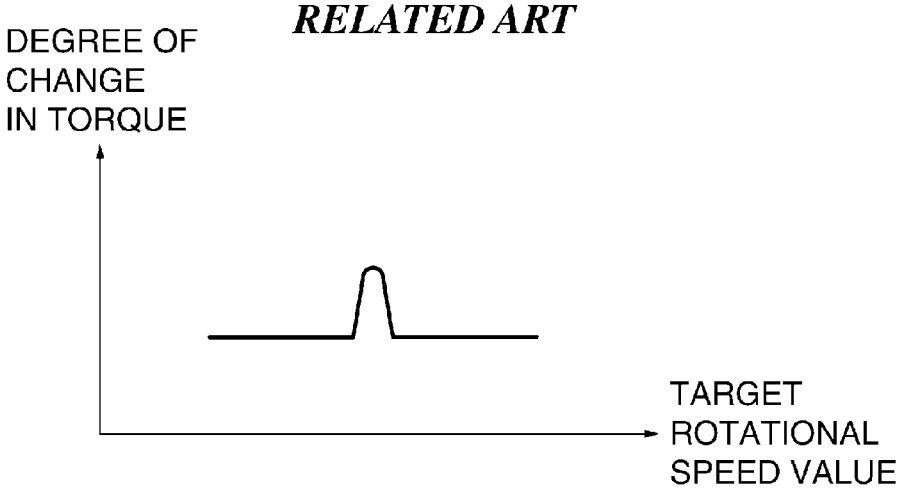
FIG. 15C RELATED ART

FIG. 14 is a flowchart of the circumferential speed difference zero point-calculating process in the image forming apparatus shown in FIG. 13. The circumferential speed difference zero point-calculating process is performed by a program stored in the ROM 2B, which is executed by the CPU 2A of the controller 2 having received a circumferential speed difference zero point calculation command from the host CPU 1.

Note that the controller 2 includes the CPU 2A that performs computations, the ROM 2B storing a controller program, a circumferential speed different zero point-calculating program and so forth, and the RAM 2C for temporarily storing detection values output from the rotary encoders 11 and 19, and other results of computations.

The circumferential speed difference zero point-calculating process is started by the CPU 2A upon receipt of the circumferential speed difference zero point calculation command from the host CPU 1 (step S21). Then, the CPU 2A starts driving the drum shaft 10 by the speed feedback control such that the surface speed of the photosensitive drum 100 becomes a predetermined process speed $V_{D_TAR}$ (step S22).

Next, the CPU 2A waits for a predetermined time period T1' to elapse from the start of driving the drum shaft 10 (step S23), and after the lapse of the predetermined time period T1', the CPU 2A starts driving of the intermediate transfer belt 107 by a PWM signal having a fixed duty factor ($D_s$ (s: 1 to S)) (step S24). Here, s represents a number assigned to each setting value of the duty factor. For example, numbers s of 1 to S are assigned to respective S setting values of the duty factor, and data of the numbers s assigned to the setting values of the fixed duty factor is stored in the ROM 2B in advance. A setting value of the fixed duty factor applied when the present process is initially started is determined by s, and the fixed duty factor associated with s=1 is represented by D1. Further, the process speed of the intermediate transfer belt 107 driven at the fixed duty factor D1 is a design value set in advance such that it is −1% or more smaller than the process speed $V_{D_TAR}$ of the photosensitive drum 100 (rotational speed characteristic).

Next, the CPU 2A waits for a predetermined time period T2' (step S25), and thereafter, starts counting the number of rising edges of the detection signal output from the rotary encoder 19, by the internal counter of the CPU 2A (step S26). Here, the predetermined time period T2' is set to a time period required for the rotational speed of the intermediate transfer belt 107 to become a stable constant speed after the start of driving the same.

Then, the CPU 2A determines whether or not the count of rising edges has reached N+1 (step S27). When the count of rising edges has reached N+1, the CPU 2A latches a value of the internal counter to store the latched value as $C_S$, in the RAM 2C, and then resets the internal counter to zero (step S28). The symbol N represents the number of slits of the rotary encoder 19, as mentioned hereinabove. Therefore, when the count ($C_S$) of the internal counter obtained when a number N+1 of rising edges are counted is equivalent to a time period over which the ITB drive roller 109 rotates through one revolution.

Next, the CPU 2A determines whether or not the current setting value s is smaller than the number S of times of measurement (step S29). Then, if the answer to this question is affirmative (YES), the CPU 2A increments the value of s by 1 to thereby set the fixed duty factor again to a setting having the incremented value, and then returns to the step S24 (step S30) to repeat the steps S24 to S29.

On the other hand, if the answer to the question of the step S29 is negative (NO), the CPU 2A stops driving the photosensitive drum 100 and the intermediate transfer belt 107 (step S31).

Next, the CPU 2A converts the value $C_S$ of each count stored in the RAM 2C to a detection time interval $T_{ES}$ at which one slit of the rotary encoder is detected (step S32). This conversion is performed by the following equation (6) mentioned above:

$$T_{ES} = \frac{C_S \times t_c}{N} \tag{6}$$

wherein $t_c$ is a clock period of the internal counter.

Next, the CPU 2A determines, as a value $T_{t1}$, a value of the detection time interval $T_{ES}$ which is within +1% with respect to the target detection time interval $T_{D_TAR}$ calculated from a target process speed of the photosensitive drum 100 (hereinafter referred to as "the drum target process speed"), and is closest thereto, and as a value $T_{t2}$, a value of $T_{ES}$ which is within −1% with respect to the same, and closest thereto (step S33). Then, the CPU 2A sets the target detection time interval $T_{TAR_R}$ to a detection time interval $T_{ES}$, associated with a setting value s' of the duty factor calculated by $[(T_{t1}-T_{t2})/2+T_{t2}]$ (step S34).

After setting the target detection time interval $T_{TAR_R}$, the CPU 2A sets a desired circumferential speed difference associated with a process speed by the following equation (9), and stores the calculated target detection time interval $T_{TAR_PV}$ having the circumferential speed difference set thereto, in the RAM 2C:

$$T_{TAR_PV} = \frac{T_{ES'}(1 - P_{PV}/100)}{T_{D_TAR}} \times T_{PV} \tag{9}$$

wherein $T_{TAR_PV}$ represents the target detection time interval having the circumferential speed difference set thereto of the rotary encoder 19, and $T_{PV}$ represents the target detection time interval of the rotary encoder 11 set when the drum target process speed of the photosensitive drum 100 is set.

The target detection time intervals $T_{D_TAR}$ and $T_{PV}$ are different in the following respects: $T_{D_TAR}$ indicates the target detection time interval set when the photosensitive drum 100 is subjected to the speed feedback control during the above-described circumferential speed difference zero point-calculating process, whereas $T_{PV}$ also represents the target detection time interval, but it includes values thereof set for other process speeds. Further, $T_{TAR_PV}$ represents the target detection time interval of the rotary encoder 19 of the intermediate transfer belt 107 set when the circumferential speed difference with respect to the drum target process speed of the photosensitive drum 100 is zero. $P_{PV}$ represents a value for designating a ratio of the circumferential speed difference, and when the setting value of the process speed of the intermediate transfer belt 107 is desired to be increased with respect to the process speed of the photosensitive drum 100, it is set to a positive value, whereas the same is desired to be reduced, it is set to a negative value. Accordingly, when the driving control is desired to be executed at a circumferential speed difference setting of +1%, a torque command value for driving the drum shaft 18 is set such that the target detection time interval $T_{TAR_PV}$ having the circumferential speed difference set thereto of the rotary encoder 19 becomes equal to a value calculated by the following equation (10:

$$T_{TAR_PV} = \frac{T_{ES'}(1 - 1/100)}{T_{D_TAR}} \times T_{PV} \tag{10}$$

Then, a normal printing operation is performed using the set torque command value.

Timing for executing the circumferential speed difference zero point-calculating process in the present embodiment is the same as that in the first embodiment, and hence description thereof is omitted.

According to the circumferential speed difference zero point-calculating process in FIG. 14, from a detection value output from the rotary encoder 19 in a state where the intermediate transfer belt 107 is being friction-driven by the photosensitive drum 100 via the contact surface of them, a target value is set for making the respective surface speeds of the two equal to each other during normal printing operation. Then, the brushless DC motor 14 is controlled such that the target value is output from the rotary encoder 19. This makes it possible to calculate a rotational speed setting value which makes the circumferential speed difference between the photosensitive drum 100 and the intermediate transfer belt 107 equal to zero, without being affected by lowering of measurement accuracy due to a change in the friction coefficient at the primary transfer section. Therefore, it is possible to stabilize the transferability at the primary transfer section. Further, by setting an appropriate circumferential speed difference with respect to the determined rotational speed setting value, it is possible to further stabilize the transferability.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-051880 filed Mar. 14, 2013, which is hereby incorporated by reference herein in its entirety.

What is claimed is:

1. An image forming apparatus comprising:

a photosensitive member configured to have a toner image formed thereon;

an intermediate transfer member configured to be rotatable in contact with said photosensitive member, for having the toner image on said photosensitive member transferred thereon;

a first drive unit configured to drive said photosensitive member for rotation;

a second drive unit configured to drive said intermediate transfer member for rotation;

a first speed detection unit configured to detect a rotational speed of said photosensitive member;

a second speed detection unit configured to detect a rotational speed of said intermediate transfer member; and a control unit configured to control said first drive unit and said second drive unit, wherein said control unit performs control other than control for normal printing operation, such that said first drive unit drives said photosensitive member with a predetermined rotational torque, in a state causing said intermediate transfer member to rotate at a predetermined rotational speed, and sets, based on a detection value from said first speed detection unit in a state in which said photosensitive member is friction-driven by said intermediate transfer member at a contact surface of said photosensitive member and said intermediate transfer member, which detection value is obtained by the control other than the control for the normal printing operation, a target value of said first speed detection unit for making a surface speed of said photosensitive member and a surface speed of said intermediate transfer member during the normal printing operation equal to each other, and controls said first drive unit such that the target value becomes a detection value.

2. The image forming apparatus according to claim 1, wherein said control unit includes a generated torque variable unit configured to be capable of vary a rotational torque of said photosensitive member, causes said generated torque variable unit to set the target value for said first speed detection unit according to a rotational speed characteristic of said first speed detection unit, and controls said first drive unit such that the target value becomes the detection value.

3. The image forming apparatus according to claim 2, wherein said control unit sets, based on the rotational speed characteristic, an average value of a detection value of said first speed detection unit, which corresponds to a speed slower by a predetermined speed than a speed which is realized by torque corresponding to the target value, and a detection value of said first speed detection unit, which corresponds to a speed faster by the predetermined speed than the speed which is realized by the torque corresponding to the target value, as the target value of said first speed detection unit.

4. The image forming apparatus according to claim 1, wherein said control unit sets a fixed speed difference between the surface speed of said photosensitive member and the surface speed of said intermediate transfer member, and sets the target speed of said first speed detection unit, using the speed difference, and controls said first drive unit such that the target value becomes the detection value during the normal printing operation.

5. The image forming apparatus according to claim 1, wherein said control unit controls said first drive unit to thereby give assist torque to said photosensitive member such that load torque acting on said photosensitive member is offset.

6. The image forming apparatus according to claim 1, wherein each of said first speed detection unit and said second speed detection unit is a rotary encoder, and the detection value is an angular speed of a rotating shaft of the rotary encoder.

7. The image forming apparatus according to claim 1, wherein each of said first drive unit and said second drive unit is a low-inertia DC motor.

8. An image forming apparatus comprising:

an photosensitive member configured to have a tone image formed thereon;

an intermediate transfer member configured to be rotatable in contact with said photosensitive member, for having the toner image on said photosensitive member transferred thereon;

a first drive unit configured to drive said photosensitive member for rotation;

a second drive unit configured to drive said intermediate transfer member for rotation;

a first speed detection unit configured to detect a rotational speed of said photosensitive member;

a second speed detection unit configured to detect a rotational speed of said intermediate transfer member; and a control unit configured to control said first drive unit and said second drive unit, wherein said control unit performs control other than control for normal printing operation, such that said second drive unit drives said intermediate transfer member with a predetermined rotational torque, in a state causing said photosensitive member to rotate at a predetermined rotational speed, and sets, based on a detection value from said second speed detection unit in a state in which said intermediate transfer member is friction-driven by said photosensitive member at a contact surface of said photosensitive member and said intermediate transfer member, which detection value is obtained by the control other than the control for the normal printing operation, a target value of said second speed detection unit for making a surface speed of said photosensitive member and a surface speed of said intermediate transfer member during the normal printing operation equal to each other, and controls said second drive unit such that the target value becomes a detection value.

9. The image forming apparatus according to claim 8, wherein said control unit includes a generated torque variable unit configured to be capable of vary a rotational torque of said intermediate transfer member, causes said generated torque variable unit to set the target value for said second speed detection unit according to a rotational speed characteristic of said second speed detection unit, and controls said second drive unit such that the target value becomes the detection value.

10. The image forming apparatus according to claim 9, wherein said control unit sets, based on the rotational speed characteristic, an average value of a detection value of said second speed detection unit, which corresponds to a speed slower by a predetermined speed than a speed which is realized by torque corresponding to the target value, and a detection value of said second speed detection unit, which corresponds to a speed faster by the predetermined speed than the speed which is realized by the torque corresponding to the target value, as the target value of said second speed detection unit.

11. The image forming apparatus according to claim 8, wherein said control unit sets a fixed speed difference between the surface speed of said photosensitive member and the surface speed of said intermediate transfer member, and sets the target speed of said second speed detection unit, using the speed difference, and controls said second drive unit during normal printing operation, such that the target value becomes the detection value during the normal printing operation.

12. The image forming apparatus according to claim 8, wherein said control unit controls said second drive unit to thereby give assist torque to said intermediate transfer member such that load torque acting on said intermediate transfer member is offset.

13. The image forming apparatus according to claim 8, wherein each of said first speed detection unit and said second speed detection unit is a rotary encoder, and the detection value is an angular speed of a rotating shaft of the rotary encoder.

14. The image forming apparatus according to claim 8, wherein each of said first drive unit and said second drive unit is a low-inertia DC motor.

* * * * *